US006184454B1

(12) United States Patent
Imai et al.

(10) Patent No.: US 6,184,454 B1
(45) **Date of Patent: *Feb. 6, 2001**

(54) APPARATUS AND METHOD FOR REPRODUCING A SOUND WITH ITS ORIGINAL TONE COLOR FROM DATA IN WHICH TONE COLOR PARAMETERS AND INTERVAL PARAMETERS ARE MIXED

(75) Inventors: Kenichi Imai, Tokyo; Minoru Tsuji, Chiba; Takashi Koike, Kanagawa, all of (JP)

(73) Assignee: Sony Corporation, Tokyo (JP)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 09/301,962

(22) Filed: Apr. 29, 1999

(30) Foreign Application Priority Data

May 18, 1998 (JP) ..... 10-134893

(51) Int. Cl.[7] ..... G10H 1/06; G10H 7/00
(52) U.S. Cl. ..... 84/622; 84/645; 84/659
(58) Field of Search ..... 84/622–625, 645, 84/659–661; 434/307 A

(56) References Cited

U.S. PATENT DOCUMENTS

| | | | | |
|---|---|---|---|---|
| 5,750,913 | * | 5/1998 | Kamiya | 84/625 |
| 5,804,750 | * | 9/1998 | Shirakawa et al. | 84/622 X |
| 5,834,670 | * | 11/1998 | Yumura et al. | 84/622 X |
| 5,889,223 | * | 3/1999 | Matsumoto | 84/622 X |
| 5,892,171 | * | 4/1999 | Ide | 84/622 |
| 5,918,301 | * | 6/1999 | Hasebe | 84/622 X |
| 5,955,693 | * | 9/1999 | Kageyama | 84/622 X |

* cited by examiner

*Primary Examiner*—Stanley J. Witkowski
(74) *Attorney, Agent, or Firm*—Limbach & Limbach L.L.P.

(57) ABSTRACT

In a tone color map generating section, a tone color parameter and the effective time for making the tone color map effective are extracted from an SMF stored in a MIDI file database, and the tone color parameter is stored in a tone color map database. When a demand processing section receives a playback start position for starting the playback of the SMF, a read processing section reads the tone color parameter stored in the tone color map database in accordance with the playback start position, and generates time information indicating time to set the tone color parameter in a MIDI device. A sending circuit sends the tone color parameter together with the corresponding time information, and then sends a MIDI signal from the playback start position thereafter, stored in the MIDI file database.

43 Claims, 18 Drawing Sheets

FIG. 12A

TONE COLOR MAP

| | | |
|---|---|---|
| EFFECTIVE TIME OF TONE COLOR MAP | | 15TH MEASURE |
| TEMPO | | 120BPM |
| TIME PATTERN | | 4/4 MEASURE |
| PROGRAM CHANGE (TONE COLOR No.) | | 01 (piano) |
| CONTROL CHANGE | BANK SELECT | 0 |
| | VOLUME | 127 |
| | VANPOT | 0(L) |

DATA NECESSARY AS CONTROL DATA = 6 EVENTS

FIG. 12B

TONE COLOR EVENTS SENT IN ONE-MEASURE PERIOD
(THIS MAY BE ARBITRARILY DETERMINED BY SENDING SYSTEM)

RESOLUTION OF ONE BEAT IS 480 (ONE BEAT IS DIVIDED BY 480)

PLAYBACK START POSITION DESIGNATED BY CLIENT = 20TH MEASURE

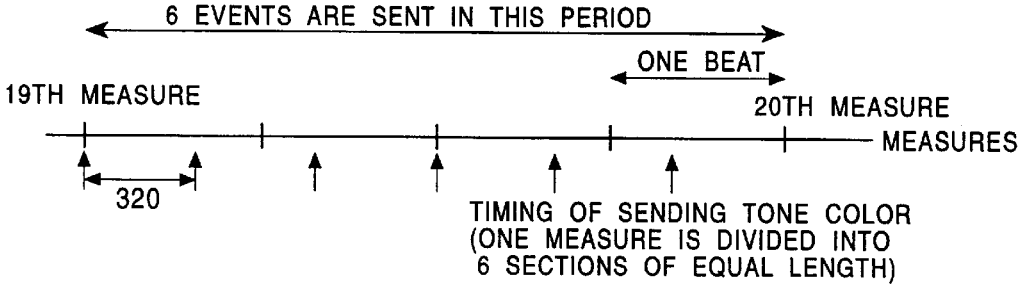

FIG. 12C

SENT MIDI DATA = TIME INFORMATION + MIDI EVENT

| MEASURE : BEAT : LESS THAN BEAT | MIDI EVENT |
|---|---|
| 19 : 1 : 000 | TEMPO DATA 120 |
| 19 : 1 : 320 | BEAT DATA 4/4 |
| 19 : 2 : 160 | PROGRAM CHANGE : 01 |
| 19 : 3 : 000 | CONTROL CHANGE (BANK SELECT) : 0 |
| 19 : 3 : 320 | CONTROL CHANGE (VOLUME) : 127 |
| 19 : 4 : 160 | CONTROL CHANGE (VANPOT) : 0 |

SENDING END SENDS THESE DATA PRIOR TO DATA THAT START FROM POSITION REQUESTED BY RECEIVING END. THIS MAY BE DONE IN THE SAME WAY AS THAT FOR SENDING ORDINARY DATA. RECEIVING END ALSO MAY RECEIVE AND PROCESS THE SENT DATA WITHOUT ANY SPECIAL CARE. (NO PROBLEM IF DATA CAN SAFELY BE PROCESSED, EVEN THOUGH THE DATA PRECEDE THE DATA DESIGNATED BY RECEIVING END.)

APPARATUS AND METHOD FOR REPRODUCING A SOUND WITH ITS ORIGINAL TONE COLOR FROM DATA IN WHICH TONE COLOR PARAMETERS AND INTERVAL PARAMETERS ARE MIXED

BACKGROUND OF THE INVENTION

1. Field of the Invention

The present invention relates to an information processing apparatus, an information processing method, and a storage medium, and, more particularly to an information processing apparatus which provides an original audio sound when an electronic musical instrument including a MIDI device plays back a file, such as an SMF (Standard MIDI (Musical Instruments Digital Interface) File), at any position other than from its front end. The SMF file here includes, at least, a tone color parameter relating to a tone color and an interval parameter relating to an interval. The present invention also relates to an information processing method and a medium for such an information processing apparatus.

2. Description of the Related Art

Available as a standard format for controlling electronic musical instruments is the MIDI standard. In an electronic keyboard instrument, for example, information in the form of MIDI events is sent to the electronic keyboard instrument in accordance with the MIDI standard. The electronic keyboard instrument is controlled based on the MIDI events so that it generates and outputs an audio sound corresponding to a key indicated by a MIDI event which is pressed.

In the above keyboard instrument, the MIDI event indicating which key to press is used to control the audio signal, and may be called an interval parameter. Besides the interval parameter, the MIDI events include the one for controlling the tone color of an electronic musical instrument (MIDI device), which may be called a tone color a parameter. Available as tone color parameters in the MIDI events are a program change, a control change, and an exclusive message (system exclusive message).

By sending the MIDI signal including the above MIDI events to the MIDI device, the MIDI device generates and outputs a diversity of tone colors and intervals.

The concept "channel" is employed in the MIDI signal format. A plurality of different channels are respectively assigned to a plurality of MIDI devices to independently control the plurality of MIDI devices.

A computer handles the MIDI signal to allow the MIDI device to automatically play. An SMF (Standard MIDI File) is available as a standardized file format to allow the computer to handle the MIDI signal, besides formats unique to individual hardware and software for automatic playing. The SMF holds tempo information and time pattern information, not relating to the MIDI signal, and with the SMF, the MIDI device changes the tempo and time pattern in the middle of a musical performance. The SMF also holds the time information about (effective) time for making effective the tone color parameter and the interval parameter.

As described above, the tempo information and the time pattern information are not the MIDI signal, and unrelated to the tone color. In this specification, however, the tempo information and the time pattern information are included in the tone color parameter for convenience of explanation.

The MIDI standard and SMF are detailed in "MIDI 1.0 Standard" (issued by Japan MIDI Standard Committee).

A tone color parameter to generate a sound having a certain tone color needs to be recorded chronologically earlier than the recorded position of an interval parameter, as a MIDI event in the SMF, a command to generate a corresponding sound. No other particular limitation is specified about the recorded position of the tone color parameter. In the SMF, the tone color parameter and the interval parameter are recorded in a mixed fashion rather than in separate partitions.

When an interval parameter as a command to generate a sound of a predetermined interval (for example, a command for pressing a predetermined key) is recorded at a position corresponding to 10 seconds after the front end of a SMF with the playback starting at the front end of the SMF, the tone color parameter for designating the tone color of the predetermined interval sound (namely, setting the predetermined tone color in the MIDI device) may be recorded anywhere between the front end of the SMF and the position corresponding to 10 seconds after the front end of the SMF.

For example, now, a tone color parameter designating a predetermined tone color is recorded at a position corresponding to 5 seconds after the front end of the SMF. When an access is made in a random fashion, for example, starting the playback at a position corresponding to 6 seconds after the front end of the SMF, the MIDI device generates the sound in accordance with an interval parameter recorded at a position corresponding to 10 seconds after the front end of the SMF. The tone color of the sound corresponds to the tone color parameter that is set to the MIDI device at that position; and does not always correspond to the tone color parameter at a position corresponding to 5 seconds after the start of the SMF. (It is more likely that the tone color of the sound fails to correspond to the position corresponding to 5 seconds after the front end.)

In the SMF, the tone color parameter is not recorded together with the interval parameter as a command for generating a sound. When a playback is made on the SMF on a random-access fashion, music is not always played at an original tone color a composer of the SMF (composer of the music (content) played by the MIDI device) intends to present.

SUMMARY OF THE INVENTION

Accordingly, it is an object of the present invention to reproduce a sound with its original tone color even when a random access is made on an SMF in which a tone color parameter and an interval parameter are mixed.

In a first aspect of the present invention, the information processing apparatus for processing mixed data, in which, at least, a tone color parameter relating to a tone color and an interval parameter relating to an interval are mixed, includes extracting means for extracting, from the mixed data, the tone color parameter and effective time at which the tone color parameter is made effective, storage means for storing the tone color parameter in a tabular form, reading means for reading the tone color parameter from the storage means in accordance with an input of a playback start position where the playback of the mixed data starts, creating means for creating time information indicating time to set the tone color parameter, read by the reading means, to an electronic apparatus that generates an audio signal based on the mixed data, and output means for outputting the tone color parameter, read by the reading means, together with the time information corresponding to the tone color parameter, and then the mixed data from the playback start position thereafter.

In a second aspect of the present invention, the information processing method for processing mixed data, in which, at least, a tone color parameter relating to a tone color and an interval parameter relating to an interval are mixed, includes the steps of extracting, from the mixed data, the tone color parameter and effective time at which the tone color parameter is made effective, storing the tone color parameter in a tabular form, reading the tone color parameter stored in the storing step, in accordance with an input of a playback start position where the playback of the mixed data starts, creating time information indicating time to set the tone color parameter read in the reading step, to an electronic apparatus that generates an audio signal based on the mixed data, and outputting the tone color parameter read in the reading step, together with the time information corresponding to the tone color parameter, and then the mixed data from the playback start position thereafter.

In a third aspect of the present invention, the medium provides a computer program, according to which a computer processes mixed data in which, at least, a tone color parameter relating to a tone color and an interval parameter relating to an interval are mixed. The computer program includes the steps of extracting, from the mixed data, the tone color parameter and effective time at which the tone color parameter is made effective, storing the tone color parameter in a tabular form, reading the tone color parameter stored in the storing step, in response to an input of a playback start position where the playback of the mixed data starts, creating time information indicating time to set the tone color parameter read in the reading step to an electronic apparatus that generates an audio signal based on the mixed data, and outputting the tone color parameter read in the reading step, together with the time information corresponding to the tone color parameter, and then the mixed data from the playback start position thereafter.

In a fourth aspect of the present invention, the information processing apparatus for receiving mixed data that is transmitted by a transmitter device, with the mixed data at least including a tone color parameter relating to a tone color and an interval parameter relating to an interval, and for supplying the mixed data to an electronic apparatus that generates an audio signal based on the mixed data, includes recognizing means for recognizing the tone color parameter set in the electronic apparatus, and sending means for sending, to the transmitter device, the tone color parameter recognized by the recognizing means.

In a fifth aspect of the present invention, the information processing method for receiving mixed data that is transmitted by a transmitter device, with the mixed data at least including a tone color parameter relating to a tone color and an interval parameter relating to an interval, and for supplying the mixed data to an electronic apparatus that generates an audio signal based on the mixed data, includes the steps of recognizing the tone color parameter set in the electronic apparatus, and sending, to the transmitter device, the tone color parameter recognized in the recognizing step.

In a sixth aspect of the present invention, the medium provides a computer program, according to which a computer performs processes for receiving mixed data that is transmitted by a transmitter device, with the mixed data at least including a tone color parameter relating to a tone color and an interval parameter relating to an interval, and for supplying the mixed data to an electronic apparatus that generates an audio signal based on the mixed data. The computer program includes the steps of recognizing the tone color parameter set in the electronic apparatus, and sending, to the transmitter device, the tone color parameter recognized in the recognizing step.

BRIEF DESCRIPTION OF THE DRAWINGS

FIG. 12A through FIG. 12C show the process executed by the read processing section 34 shown in FIG. 11;

DESCRIPTION OF THE PREFERRED EMBODIMENTS

Figure 1:
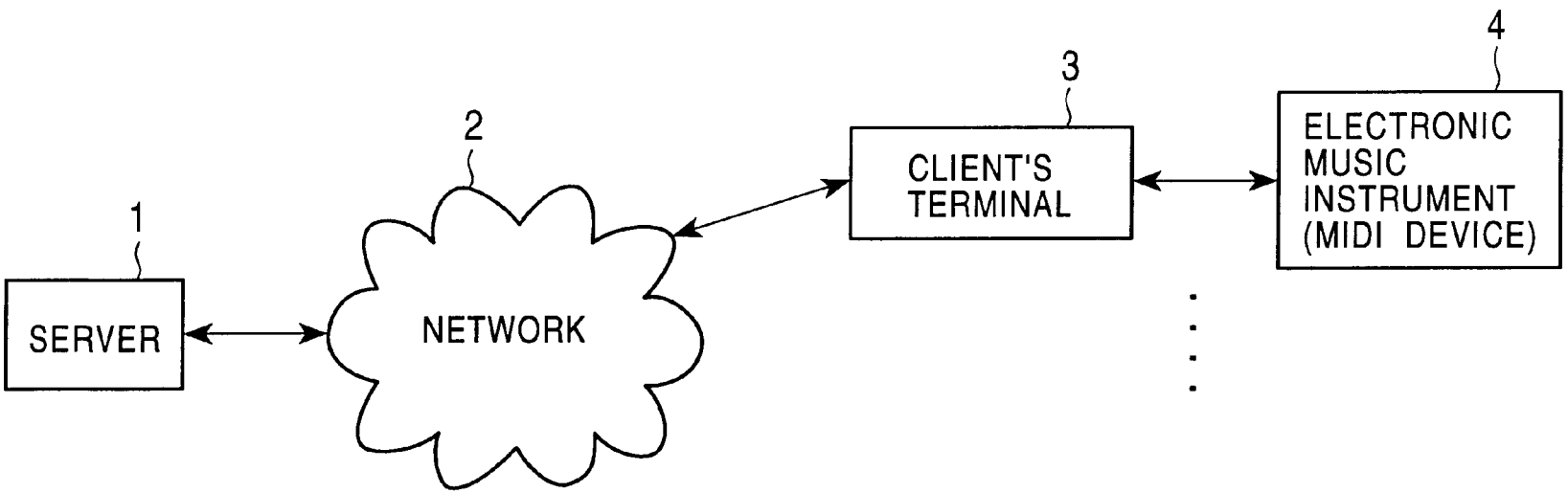
FIG. 1 is a block diagram showing one embodiment of the data transmission system that implements the present invention.

FIG. 1 shows one embodiment of data transmission system of the present invention (the system refers to a group of logically related apparatuses working together and each apparatus is not necessarily housed in a single apparatus body).

For example, when a client terminal 3 requests a song from a server 1 via a network 2 such as the Internet, ISDN (Integrated Services Digital Network), LAN (Local Area Network), or PSTN (Public Switched Telephone Network), the server 1 (transmitter device) sends the requested song, for example, a MIDI signal and other signal for making an electronic musical instrument 4, as a MIDI device, play the song, via the network 2 to the client terminal 3. The client terminal 3 (control device) receives the MIDI and other signals from the server 1, and supplies them to the electronic musical instrument 4. In this way, the electronic musical instrument 4 plays the song in accordance with the MIDI signal.

Figure 2:
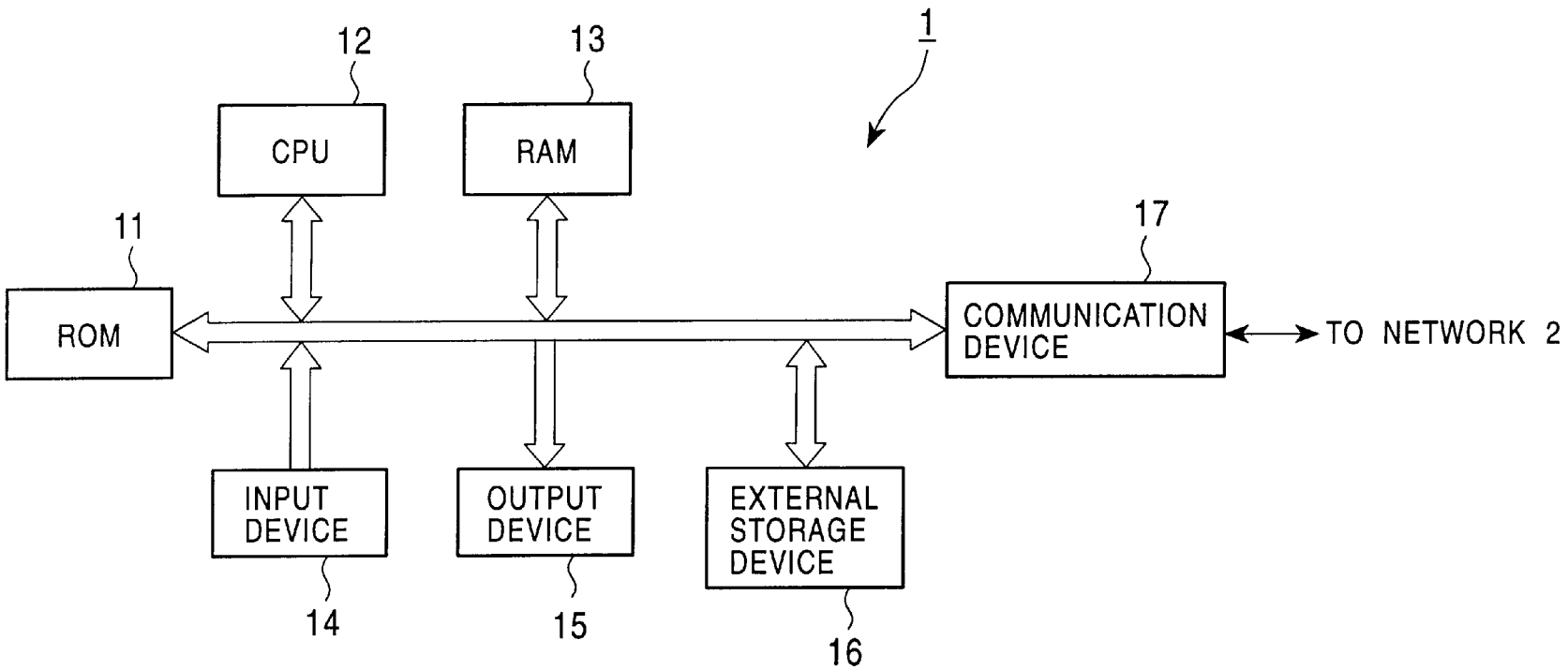
FIG. 2 is a block diagram showing the hardware structure of a server 1 shown in FIG. 1.

FIG. 2 shows the hardware structure of the server 1 shown in FIG. 1.

ROM (Read Only Memory) 11 stores an IPL (Initial Program Loading) program, for example. CPU (Central Processor Unit) 12 executes an OS (Operating System) program stored (recorded) in an external storage device 16, under the control of the IPL program stored in ROM 11, and then executes a variety of application programs stored in the external storage device 16, under the control of the OS. CPU 12 thus performs a tone color map generation process and a send process of the MIDI and other signals to the client terminal 3. RAM (Random Access Memory) 13 stores programs and data, which CPU 12 needs in operation. An input device 14 is typically a keyboard, a mouse, or a microphone, and is operated to input required data and commands. An output device 15 is typically a display, a loudspeaker, or a printer, and presents and outputs required information. The external storage device 16 is typically a hard disk, and stores the OS, the application programs, files holding the MIDI signal for a user, and the tone color map to be described later. The external storage device 16 further stores data, which CPU 12 needs in operation. A communication device 17 performs control required for communications through the network 2.

Figure 3:
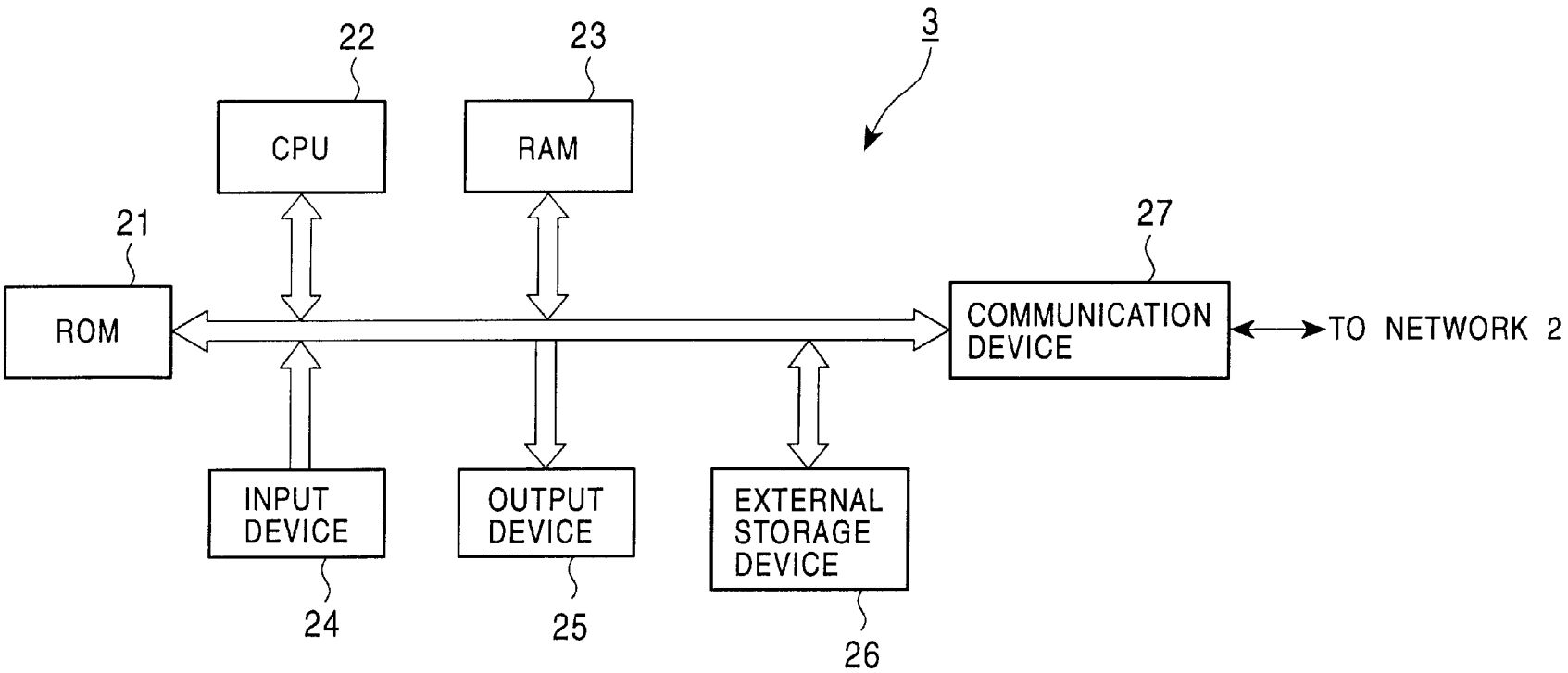
FIG. 3 is a block diagram showing the hardware structure of a client terminal 3 shown in FIG. 1.

FIG. 3 shows the hardware structure of the client terminal 3 shown in FIG. 1.

The client terminal 3 includes ROM 21 through a communication device 27, and is basically identical in construction to the server 1 which is composed of ROM 11 through the communication device 17.

An external storage device 26 stores programs that requests the MIDI signal from the server 1 and feeds it to the electronic musical instrument 4. CPU 22 executes these programs, receives the MIDI signal from the server 1 and makes the electronic musical instrument 4 play music.

Figure 4:
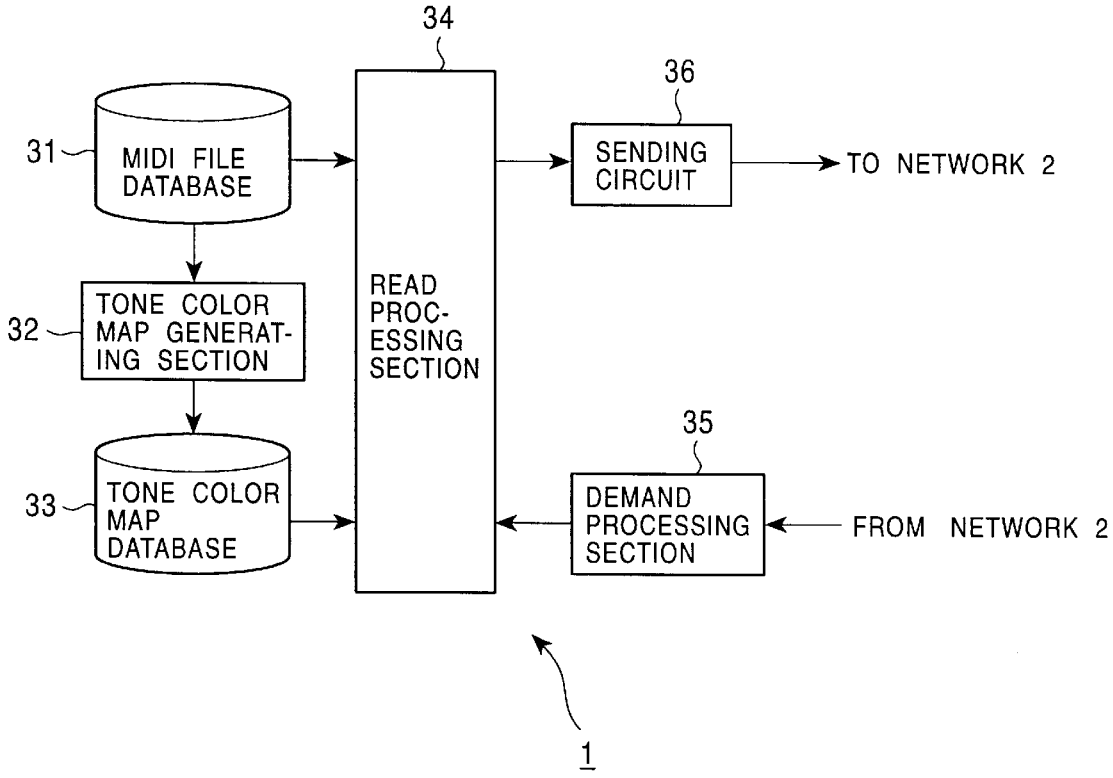
FIG. 4 is a functional block diagram showing the server 1 shown in FIG. 2.

FIG. 4 is a functional block diagram of the server 1 shown in FIG. 2. The construction shown FIG. 4 is realized with CPU 12 executing the application programs stored in the external storage device 16.

A MIDI file database 31 is a CD-ROM (Compact Disk ROM), a floppy disk, a hard disk, an magneto-optic disk, or a phase-change dual-function disk, for example, and stores (records) SMFs, which are files for making the MIDI device automatically play. Besides the SMF files, the MIDI file database 31 may store a file having a format unique to the sever 1 (defacto MIDI file), in which a MIDI event and effective time for making the event effective are recorded.

A tone color map generating section 32 extracts, from the SMF stored in the MIDI file database 31, a tone color parameter and the effective time for making the tone color effective, and performs a tone color map generation process for generating a tone color map that is a table of the tone color parameter, based on the tone color parameter and the effective time. A tone color map database 33 has the same construction as the MIDI file database 31, and stores the tone color map produced by the tone color map generating section 32.

A read processing section 34 reads data from the MIDI file database 31 and tone color map database 33 in response to a demand from a demand processing section 35, and performs required process on the data before supplying them to a sending circuit 36. The demand processing section 35 receives a request of music from the client terminal 3 via the network 2, and controls the read processing section 34 in accordance with the request. The sending circuit 36 converts the data output by the read processing section 34 into data having a format compatible with the communications protocol of the network 2, and sends the resulting data to the client terminal 3 via the network 2.

In this way, the server 1 performs the tone color map generation process for generating the tone color map and the sending process for sending the MIDI and other signals to the client terminal 3.

Figure 5:
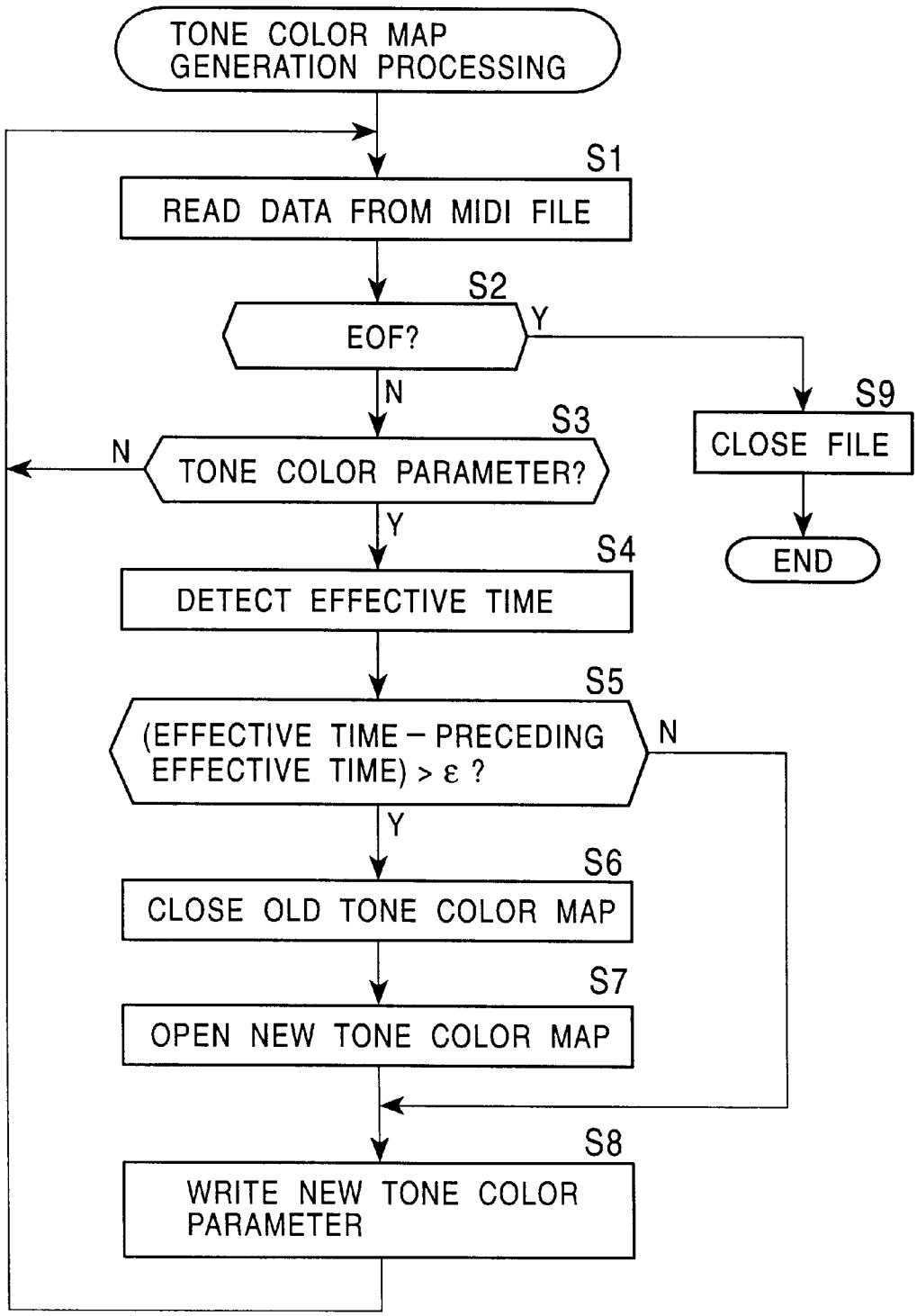
FIG. 5 is a flow diagram showing a tone color map generation process by the server 1.

Referring to a flow diagram shown in FIG. 5, the tone color map generation process is discussed.

The tone color map generation process is executed by the tone color map generating section 32 each time the MIDI file database 31 stores a new SMF file.

Specifically, when the MIDI file database 31 stores a new SMF file, the tone color map generating section 32 scans the new SMF file from its front end in step S1, reading a MIDI event held in the SMF file, such as an interval parameter and a tone color parameter (including tempo information and time pattern information, as already discussed). It is determined in step S2 whether the data read in step Si is an EOF (End of File). When it is determined in step S2 that the data read in step S1 is not an EOF, the process goes to step S3 to determine whether the data is a tone coloriparameter. When it is determined in step S3 that the data read in step S1 is not a tone color parameter, the process returns to step S1. Next recorded data is then extracted from the SMF file, and then the same process steps are repeated.

When it is determined in step S3 that the data read in step S1 is a tone color parameter, i.e., when a tone color parameter is read from the SMF file, the process goes to step S4. Effective time for making the tone color parameter effective is extracted (detected) from the SMF file.

In the SMF file, the effective time for making effective the MIDI event (for example, in case of the interval parameter, the time to generate the sound in accordance with the interval parameter, and in case of the tone color parameter, the time to set the tone color parameter in the MIDI device) is indicated in a relative time (measured in milliseconds) from the effective time of the immediately prior MIDI event. An absolute time (time measured from the front end of the SMF, namely, recorded position) as the effective time of the MIDI event stored in the SMF file is determined by counting relative times stored in the SMF file from the front end.

When a file stored in the MIDI file database 31 is not the SMF file but is the one having a format unique to the server 1, the unique format file provides the effective time of the MIDI event in that unique format. For example, the effective time of the MIDI event may be given in measures and beats on music paper. If the tempo information and the time pattern are recorded in the file, the effective time (in hours, minutes and seconds), represented in absolute time from the front end of the file, is thus obtained.

After the effective time of the tone color parameter is extracted in step S4, the process goes to step S5. It is determined in step S5 whether the differential between the effective time (of the tone color parameter presently extracted) and the effective time of the tone color parameter previously extracted is greater than a predetermined threshold value E. When it is determined in step S5 that the differential between the effective time of the presently extracted tone color parameter and the effective time of the previously extracted tone color parameter is greater than the threshold value E, the process goes to step S6. The file that was opened to record the tone color map (hereinafter referred to as tone color map file, as appropriate) is closed in the tone color map database 33. The process goes to step S7, where a new tone color map file is opened in the tone color map database 33. The process goes to step S8.

In step S8, the presently extracted tone color parameter, as an element constituting the table of the tone color map, is written onto the tone color map file opened in the tone color map database 33. The process returns to step S1, and the same process steps are now repeated.

When it is determined in step S5 that the differential between the effective time of the presently extracted tone color parameter and the effective time of the previously extracted tone color parameter is not greater than the threshold value $\epsilon$, the process goes to step S8, skipping steps S6 and S7. The presently extracted tone color parameter is written onto the tone color map file opened in the tone color map database 33. The process returns to step S1, and the same process steps are now repeated.

When it is determined in step S2 that the data read in step S1 is an EOF, the process goes to step S9. The tone color map file opened in the tone color map database 33 is closed to end the tone color map generation process.

When a tone color parameter is first extracted from the SMF file, steps S5 and S6 are skipped. In this case, after the effective time of the first tone color parameter is extracted in step S4 from the SMF file, the process goes to step S7, skipping steps S5 and S6. A new tone color map file is opened in the tone color map database 33. In step S8, the tone color parameter first extracted from the SMF file is written onto the tone color map file opened in the tone color map database 33.

In the tone color map generation process, when the differential between the effective time of the presently extracted tone color parameter and the effective time of the previously extracted tone color parameter is greater than the threshold value $\epsilon$, the presently extracted tone color parameter is written onto the tone color map file newly opened in the tone color map database 33 (different from the already opened tone color map file). When the differential between the effective time of the presently extracted tone color parameter and the effective time of the previously extracted tone color parameter is not greater than the threshold value $\epsilon$, the presently extracted tone color parameter is written onto the tone color map file already opened in the tone color map database 33. The reason for this is as follows.

The MIDI signal is a serial format signal, and even if the user wants to make effective (generate) a plurality of MIDI events at the same moment, the effective times of the plurality of MIDI events do not (cannot) coincide with each other. For example, when a plurality of tone color parameters are used to control one tone color, the plurality of tone color parameters ideally have the same effective time, but making them coincide with each other is impossible for the above reason. The effective times of the plurality of tone color parameters are set within a relatively narrow range. In other words, one tone color parameter to control one tone color and another color parameter to control another tone color are not recorded in not so close proximity. When the differential between the effective time of the presently extracted tone color parameter and the effective time of the previously extracted tone color parameter is greater than the threshold value $\epsilon$, these tone color parameters are regarded as the ones for controlling different tone colors, and are placed in different tone color maps. On the other hand, when the differential between the effective time of the presently extracted tone color parameter and the effective time of the previously extracted tone color parameter is not greater than the threshold value $\epsilon$, these tone color parameters are regarded as the ones for controlling the same tone color, and are placed in the same tone color map.

Figure 6:
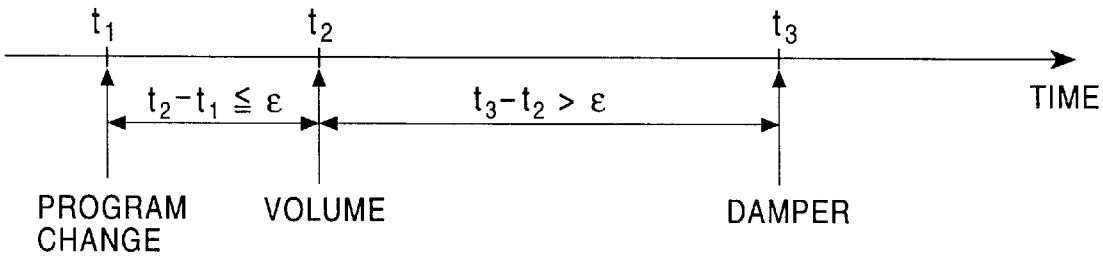
FIG. 6 illustrates a process step S5 shown in FIG. 5.

Referring to FIG. 6, a program change, a volume and a damper, as the tone color parameters, have effective times $t_1$, $t_2$ and $t_3$, respectively. When $t_2-t_1$ is smaller than the threshold value $\epsilon$ and when $t_3-t_2$ is greater than the threshold value $\epsilon$, the program change and the volume are regarded as the ones for controlling the same tone color and are placed in the same tone color map. The damper is then regarded as the one for controlling a different tone color and is placed in a tone color map different from that of the program change and the volume.

The operator of the server 1 can use any value for the threshold value $\epsilon$. The threshold value $\epsilon$ is preferably a value equal to the time length of one beat or one measure.

When the differential between the effective time of the presently extracted tone color parameter and the effective time of the previously extracted tone color parameter is equal to or smaller than the threshold value $\epsilon$, the two tone color parameters are placed in the same tone color map, in principle, as already described above. However, when the tone color map already contains a tone color parameter of the same type as that of the presently extracted tone color parameter and having a different parameter value, the presently extracted tone color parameter is placed in a different tone color map even if the differential between the effective time of the presently extracted tone color parameter and the effective time of the previously extracted tone color parameter is equal to or smaller than the threshold value $\epsilon$. When the tone color map already contains the tone color parameter of the same type as the presently extracted tone color parameter and having a different parameter value, the presently extracted tone color parameter and the tone color parameter already placed in the tone color map are thought of as controlling different tone colors.

In the embodiment shown in FIG. 5 (also in FIG. 8), a determination of whether to place the presently extracted tone color parameter in the tone color map in which the previously extracted tone color parameter is placed, or in a new tone color map, i.e., a determination of whether the presently extracted tone color parameter and the previously extracted tone color parameter control the same tone color or different tone colors, is made based on the differential between their effective times. The determination may also be made based on whether a MIDI event for commanding the generation of a sound is present between the presently extracted tone color parameter and the previously extracted tone color parameter. When a MIDI event for commanding the generation of a sound is present between the two tone color parameters, the two tone color parameters are thought of as controlling different tone colors.

Figure 7:
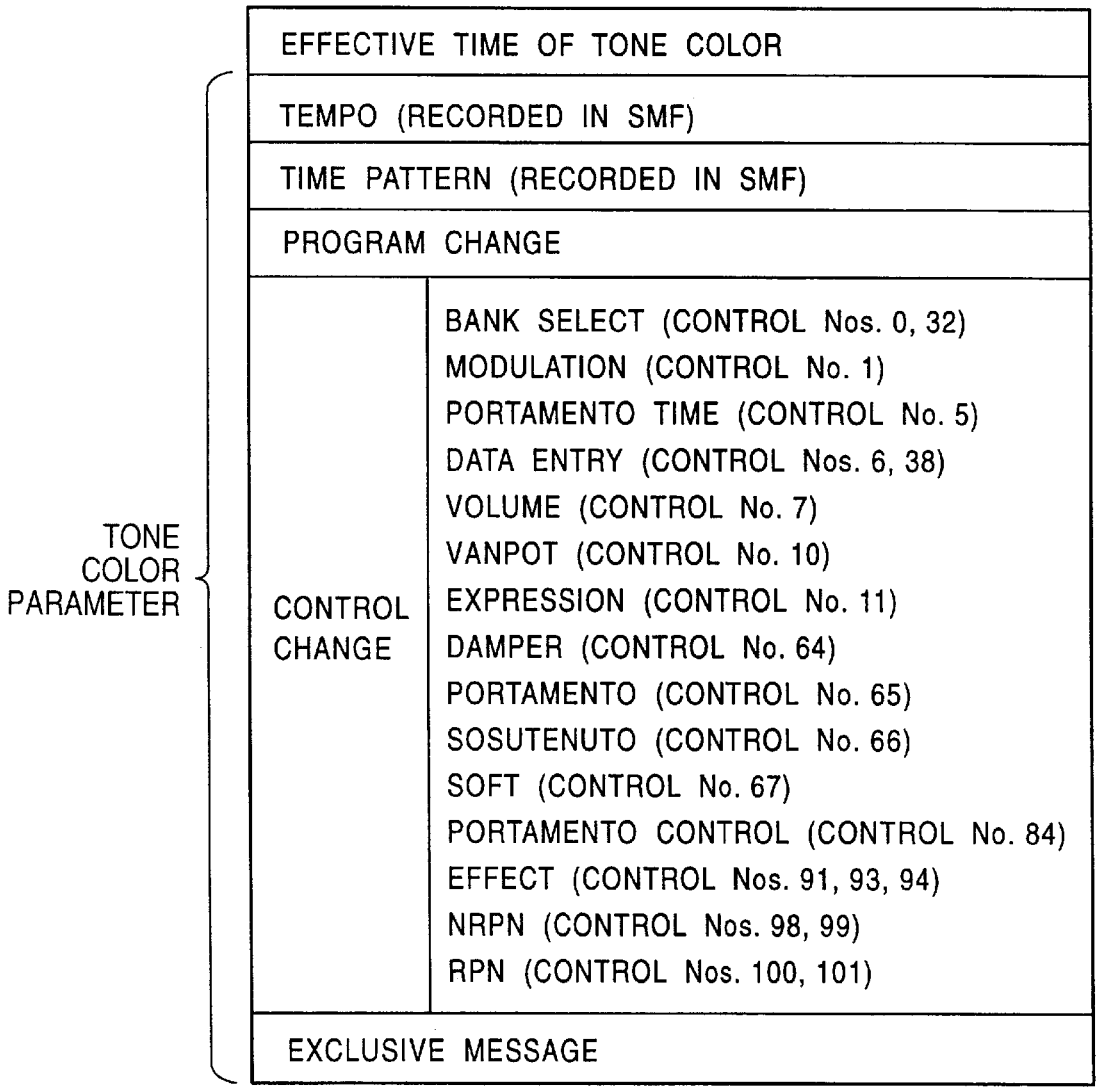
FIG. 7 is a tone color map.

FIG. 7 shows a tone color map created through the tone color map generation process executed by the tone color map generating section 32.

The tone color map includes at least the effective time for making effective the tone color map (time to make effective a tone color parameter placed in the tone color map), and the tone color parameter.

The effective time of the tone color map (time to make effective the tone color map) is, for example, the effective time of the tone color parameter placed at the beginning of the tone color map, and is a value represented in measures and beats. The effective time of the tone color map is written at the same moment the tone color map is written on the tone color map file after it is opened.

In the embodiment shown in FIG. 7, the tempo information and the time pattern information, of the tone color parameter, recorded in the SMF file, are placed as they are.

As other tone color parameters, the embodiment shown in FIG. 7 includes a program change, a control change, and a exclusive message. The control change includes bank select, modulation, portamento time, data entry, volume, vanpot, expression, damper, portamento, sosutenuto, soft, portamento control, effect, NRPN, and RPN. These parameters are detailed in above-referenced "MIDI 1.0 Standard".

Although the program change is common among the MIDI sound sources, some of control changes and the exclusive message are different from MIDI sound source to MIDI sound source. Referring to FIG. 7, a control number in parentheses following its respective tone color parameter in the control change is a number identifying each tone color parameter. For example, the bank select has two control numbers of 0 and 32. The setting of a parameter value of the bank select identified by control number 0 is made by sending a parameter value to be set, in succession to control number 0.

Figure 8:
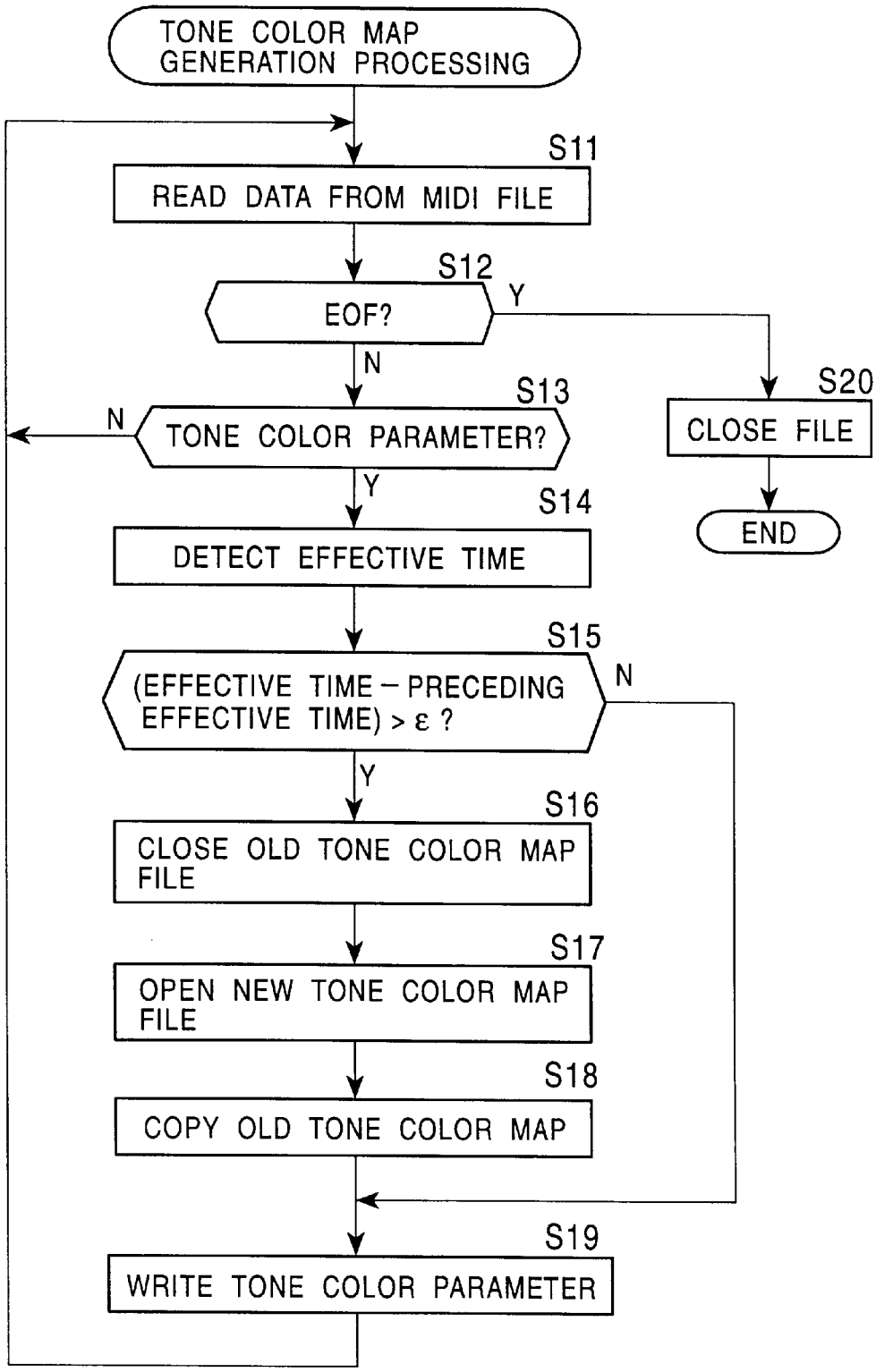
FIG. 8 is a flow diagram showing the tone color map generation process executed by the server 1 in another embodiment.

Referring to a flow diagram shown in FIG. 8, another embodiment of the tone color generation process is discussed.

In its steps S11 through S17, S19 and S20, the embodiment shown in FIG. 8 performs the same process steps as steps S1 through S9 shown in FIG. 5. The difference between the embodiment shown in FIG. 8 and the embodiment shown in FIG. 5 lies in that step S18, subsequent to step S17 and prior to step S19, is carried out.

In the embodiment shown in FIG. 8, a new tone color map file is opened in step S17, and the content of the tone color map file that has been opened is copied onto the new tone color map file. In step S19, the tone color parameter is written.

In the embodiment shown in FIG. 8, all contents of the preceding tone color map file are copied onto the new tone color map file. Although the size of the tone color map file increases, the created tone color map more precisely reproduces the sound having the tone color in accordance with the SMF file.

The server 1 generates the tone color map in this way, and sends the tone color map generated for the SMF file in which the MIDI signal is recorded, prior to the SMF file, when the client terminal 3 requests the MIDI signal. When a playback is requested at any position in the SMF file, the musical instrument 4 on the client terminal 3 plays music at the sound having the original tone color the composer of the SMF file intends to present. The server 1 thus provides services with user interaction capability.

The time required to send the tone color map to the client terminal 3 from the server 1 is typically 1 to 2 seconds, though no particular specification about it is provided. There is, therefore, a waiting time of, at least, 1 to 2 seconds after the request for the MIDI signal is placed with the server 1.

Because of the characteristics of the MIDI device, the musical instrument 4 takes 50 milliseconds or so from the reception of the tone color parameter to the setting of the tone color parameter, i.e., before the musical instrument 4 modifies its internal state to output a sound matching the tone color parameter. The sending of the tone color map must be completed at least 50 milliseconds before the musical instrument 4 receives a MIDI event appearing in the SMF file first from a position at which the client terminal 3 wants the SMF file to be sent.

Figure 9A:
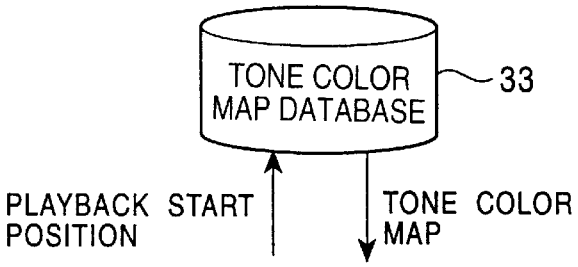
FIG. 9A through FIG. 9C illustrate a first sending method to a third sending method for sending the tone color map.
Figure 9B:
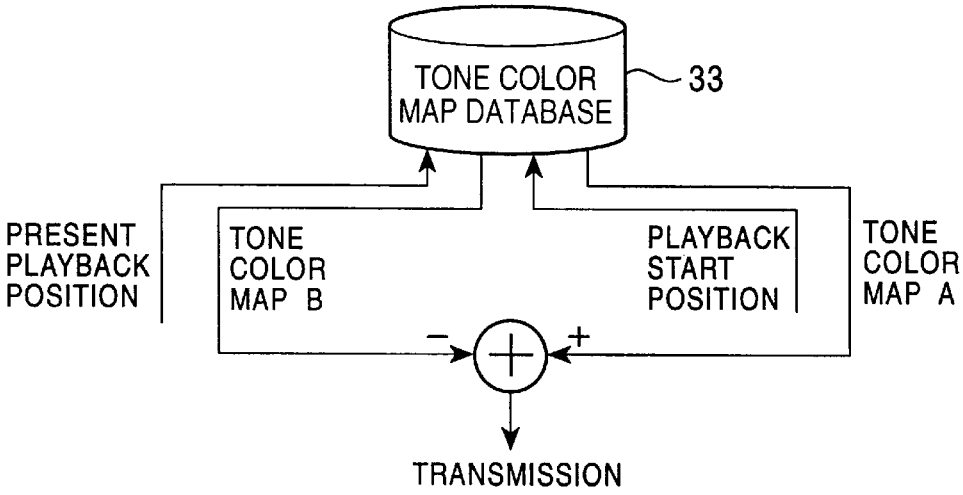
Figure 9C:
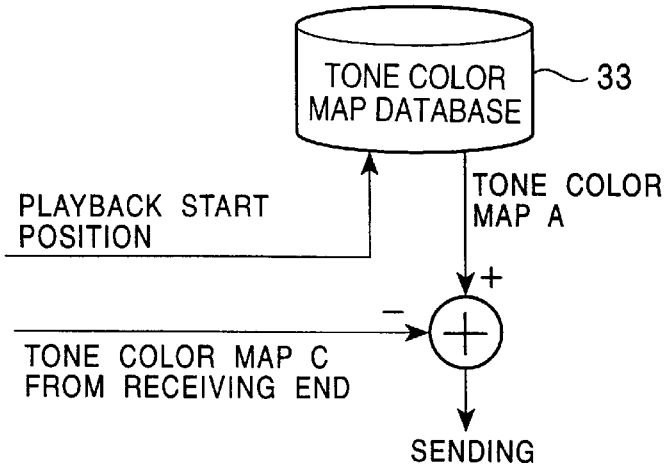

The three methods of sending the tone color map to the client terminal 3 will be described as shown in FIGS. 9A through 9C.

In a first method shown in FIG. 9A, the tone color map in which the time immediately prior to a playback start position of the SMF file requested by the client terminal 3 is placed as an effective time (i.e., the tone color map in which the effective time is prior to and closest to the playback start time) is retrieved from the tone color map database 33. The tone color map is then sent to the client terminal 3. Since the entire tone color map is sent in this case, the MIDI device plays music at the sound having the tone color the composer of the SMF file intends to present. However, the amount of data sent to the client terminal 3 is large. When the sending of the SMF file, requested by the client terminal 3, has already been in progress, a request of a playback may come in the middle of the SMF file. In such a case, some or all of the tone color parameters placed in the tone color map being sent in response to the playback request are already set in the musical instrument 4. The sending of the entire color map duplicates the sending of the tone color parameters already set in the musical instrument 4, resulting in a drop in efficiency.

In a second method shown in FIG. 9B, the following are retrieved from the tone color map database 33: (1) a tone color map A, in which the time immediately prior to a playback start position of the SMF file requested by the client terminal 3 is placed as an effective time; and (2) a tone color map B, in which the time immediately prior to the position of the SMF presently being played back in the musical instrument 4 (hereinafter referred to as present playback position) is placed as an effective time. The differential information between the tone color map A and the tone color map B is determined and sent to the client terminal 3.

The server 1 recognizes the present playback position by causing the client terminal 3 to send it thereto along with the playback start position. Alternatively, the server 1 may request the client terminal 3 to send the present playback position thereto after receiving the playback request starting with the playback start position. Alternatively, when the server 1 receives the playback start position from the client terminal 3 in the middle of the sending of the SMF to the client terminal 3, the server 1 may estimate, to be the present playback position, the position of the SMF that is sent to the client terminal 3 immediately prior to receiving the playback request starting with the playback start position. If the present playback position is estimated in this way, the communication time between the server 1 and the client terminal 3 and the time required to send the data received by the client terminal 3 to the musical instrument 4 are assumed to be zero, though they are not zero in practice. Although the estimated present playback position is not very accurate, the client terminal 3 is freed from the responsibility of recognizing and sending the present playback position. The load on the client terminal 3 is thus reduced.

In a third method shown in FIG. 9C, a tone color map A in which the time immediately prior to a playback start position of the SMF file requested by the client terminal 3 is placed as an effective time is retrieved from the tone color map database 33. The differential information between the tone color map A and a tone color map C organized by tone color parameters currently set in the musical instrument 4 is determined, and is then sent to the client terminal 3. The tone color map C is required in this method. The server 1 may acquire it by causing the client terminal 3 to send the tone color map C together with the playback start position, or by particularly requesting the tone color map C from the client terminal 3.

Discussed next is the send processing the server 1 carries out in accordance with the above first through third methods.

Figure 10:
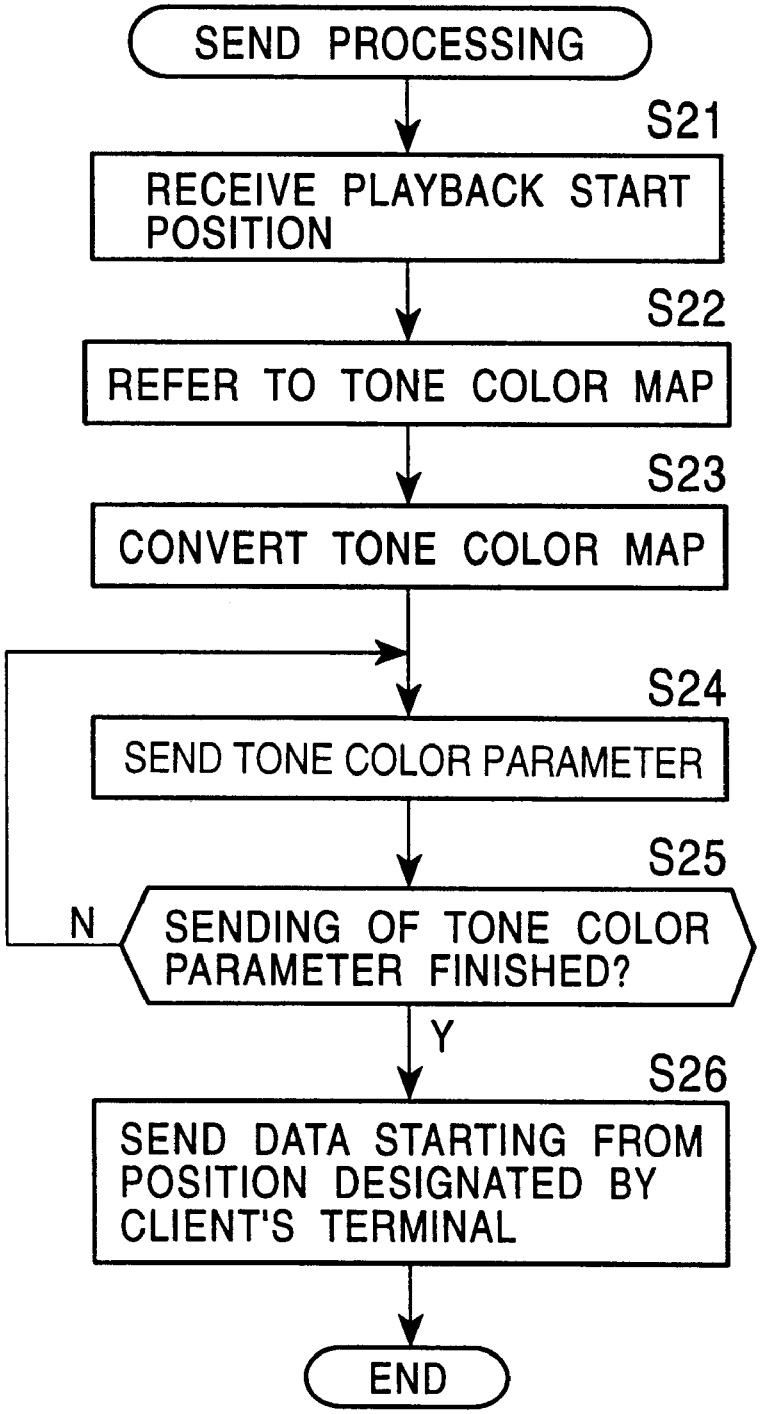
FIG. 10 is a flow diagram showing the first sending method for sending the tone color map.

Referring to the flow diagram shown in FIG. 10, the first method of the send processing is discussed.

The client terminal 3 sends the SMF file name for playback and its playback start position via the network 2. In step S21, the server 1 (see FIG. 4) receives the file name and the playback start position at its demand processing section 35, and feeds them to its read processing section 34. Upon receiving the file name and the playback start position, the read processing section 34 reads the tone color map corresponding to the file name and the playback start position from the tone color map database 33 in step S22. Specifically, the read processing section 34 reads, from the tone color map database 33, the tone color map in which the time immediately prior to the playback start position is the effective time, out of the tone color maps generated for the SMF file name coming from the demand processing section 35.

The read processing section 34 performs a tone color map conversion process in step S23 to convert the tone color map read from the tone color map database 33 into the tone color parameter included therein and time information indicating time of setting the tone color parameter in the musical instrument 4. Specifically, the read processing section 34 creates the time information of the tone color parameter placed in the tone color map read from the tone color map database 33, based on the effective time of the tone color map, as will be discussed later. The read processing section 34 sends, to the sending circuit 36, the tone color parameter placed in the tone color map read from the tone color map database 33, together with the time information.

The sending circuit 36 sends the tone color parameter and the time information from the read processing section 34 to the client terminal 3 via the network 2 in step S24.

The process goes to step S25. The read processing section 34 determines whether all tone color parameters placed in the tone color map are sent. When it is determined in step S25 that all tone color parameters placed in the tone color map are not yet sent, the process returns to step S24 to send unsent tone color parameters and time information. When it is determined in step S25 that all tone color parameters placed in the tone color map are sent, the process goes to step S26. The read processing section 34 reads, from the MIDI file database 31, the SMF file having the file name from the demand processing section 35, and feeds MIDI events, in the SMF file, which are recorded after the playback start position from the demand processing section 35, together with the effective time (hereinafter also referred to as time information), to the sending circuit 36 for sending. This completes the send processing.

Figure 11:
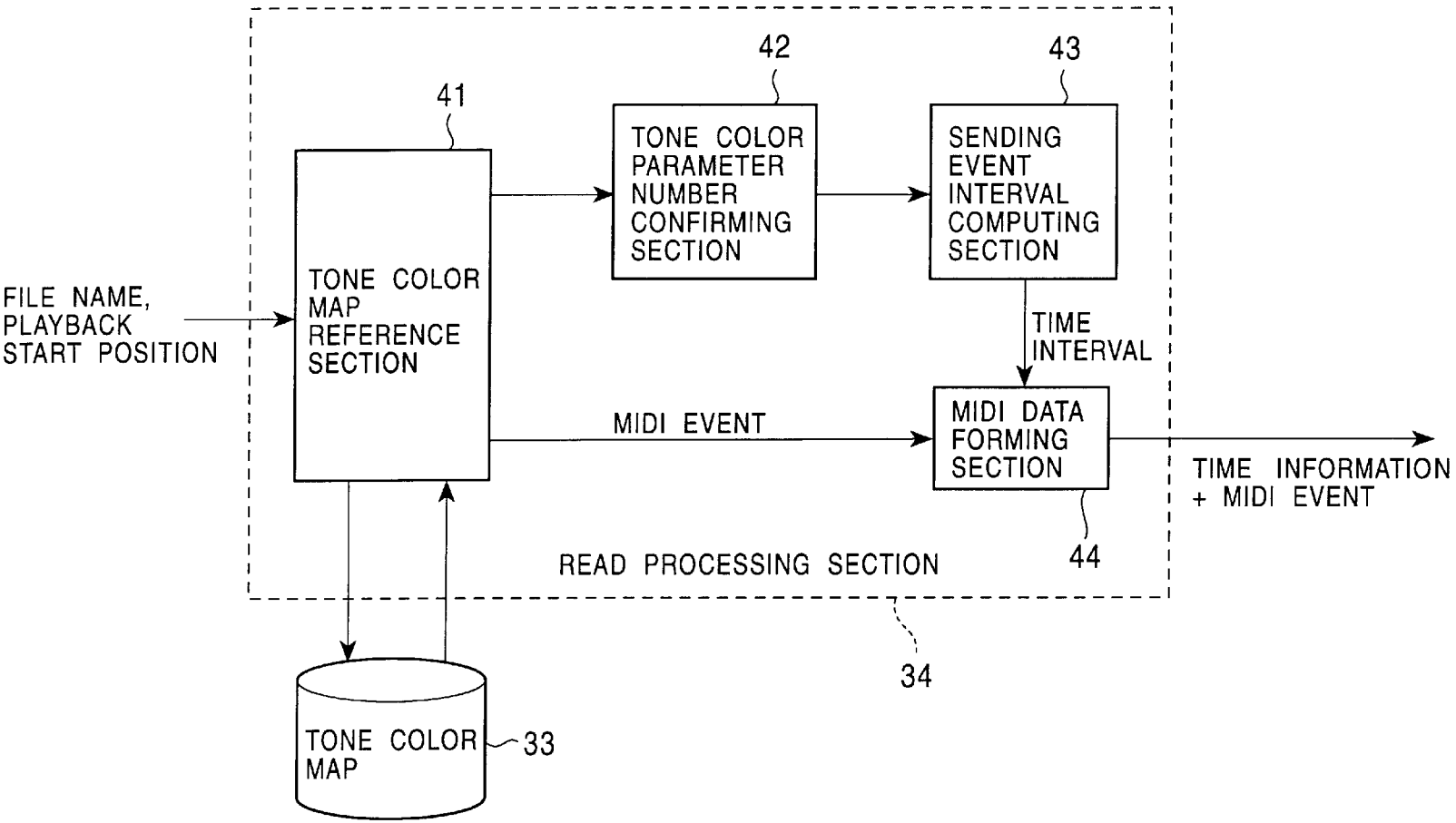
FIG. 11 is a functional block diagram of a read processing section 34 shown in FIG. 4.

FIG. 11 is a functional block diagram of the read processing section 34 shown in FIG. 4.

A tone color map reference section 41 is supplied with the file name and the playback start position which the demand processing section 35 (see FIG. 4) receives from the client terminal 3. The tone color map reference section 41 reads, from the tone color map database 33, the tone color map corresponding to the file name and the playback start position. The tone color map reference section 41 feeds the read tone color map to a tone color parameter number confirming section 42 while feeding the tone color parameter (MIDI event) placed in the tone color map to a MIDI data forming section 44.

The tone color parameter number confirming section 42 recognizes the number of tone color parameters placed in the tone color map supplied by the tone color map reference section 41, and then feeds it together with the tempo information and the time pattern information placed in the tone color map to a sending event interval computing section 43. The sending event interval computing section 43 computes an interval (time interval) between the effective times of the tone color parameters placed in the tone color map, based on the data from the tone color parameter number confirming section 42.

Now, the tone color map reference section 41 reads the tone color map shown in FIG. 12A from the tone color map database 33, and feeds it to the tone color parameter number confirming section 42. The tone color parameter number confirming section 42 recognizes the number of tone color parameters, as six events, namely, the tempo information, the beat information, the program change, and the three control changes (bank select, volume, and vanpot in the embodiment shown in FIG. 12A). The tone color parameter number confirming section 42 sends, to the sending event interval computing section 43, this number together with the tempo information (120 BPM (Beats per Minute), namely, the number of quarter notes per minute, in the embodiment shown in FIG. 12A) and the beat information (four-quarter measure in the embodiment shown in FIG. 12A).

In the server 1, for example, the send time for the tone color parameter is set be a time length of one measure, and time counting is carried out according to a resolution of one section. One beat here is divided into 480 sections. The playback start position requested by the client terminal 3 is now the front end of a 20-th measure, for example.

The sending event interval computing section 43 computes the time interval that presents the time information that permits six tone color parameters to be set in the musical instrument 4 at regular intervals for a duration between one measure before the front end of the 20-th measure and the front end of the 20-th measure.

Specifically, the sending event interval computing section 43 computes a time interval of 320 sections (one beat here is divided into 480 sections), corresponding to one duration that is obtained by dividing, by six, one measure starting with the front end of the 19-th measure, one measure earlier than the 20-th measure, and ending with the front end of the 20-th measure.

The time interval determined by the sending event interval computing section 43 is fed to the MIDI data forming section 44. Based on the time interval of the sending event interval computing section 43, the MIDI data forming section 44 computes the time information of each tone color parameter placed in the tone color map. The time information is output, together with the corresponding tone color parameter from the tone color map reference section 41, to the sending circuit 36.

The tone color map shown in FIG. 12A is now read from the tone color map database 33 and a segmentation of 320 sections are computed as the time interval. The position every 320 sections is computed from the front end of the 19-th measure, one measure earlier than the 20-th measure as shown in FIG. 20B. Specifically, if the time information is expressed in a format of measure:beat:number of sections, the following pieces of time information are computed: 19:1:000, 19:1:320, 19:2:160, 19:3:000, 19:3:320, and 19:4:160. Referring to FIG. 12C, these six pieces of time information are respectively associated with the tone color parameters of the tempo information, the beat information, the program change, the bank select, the volume, and the vanpot, placed in the tone color map (FIG. 12A) read from the tone color map database 33.

The playback start position, requested by the client terminal 3, is the 20-th measure while the server 1 sends the data starting with the 19-th measure prior to the 20-th measure. For this reason, the client terminal 3 and the musical instrument 4 are required to process the data chronologically earlier than the playback start position requested (the MIDI devices generally have such a processing capability).

Figure 13:
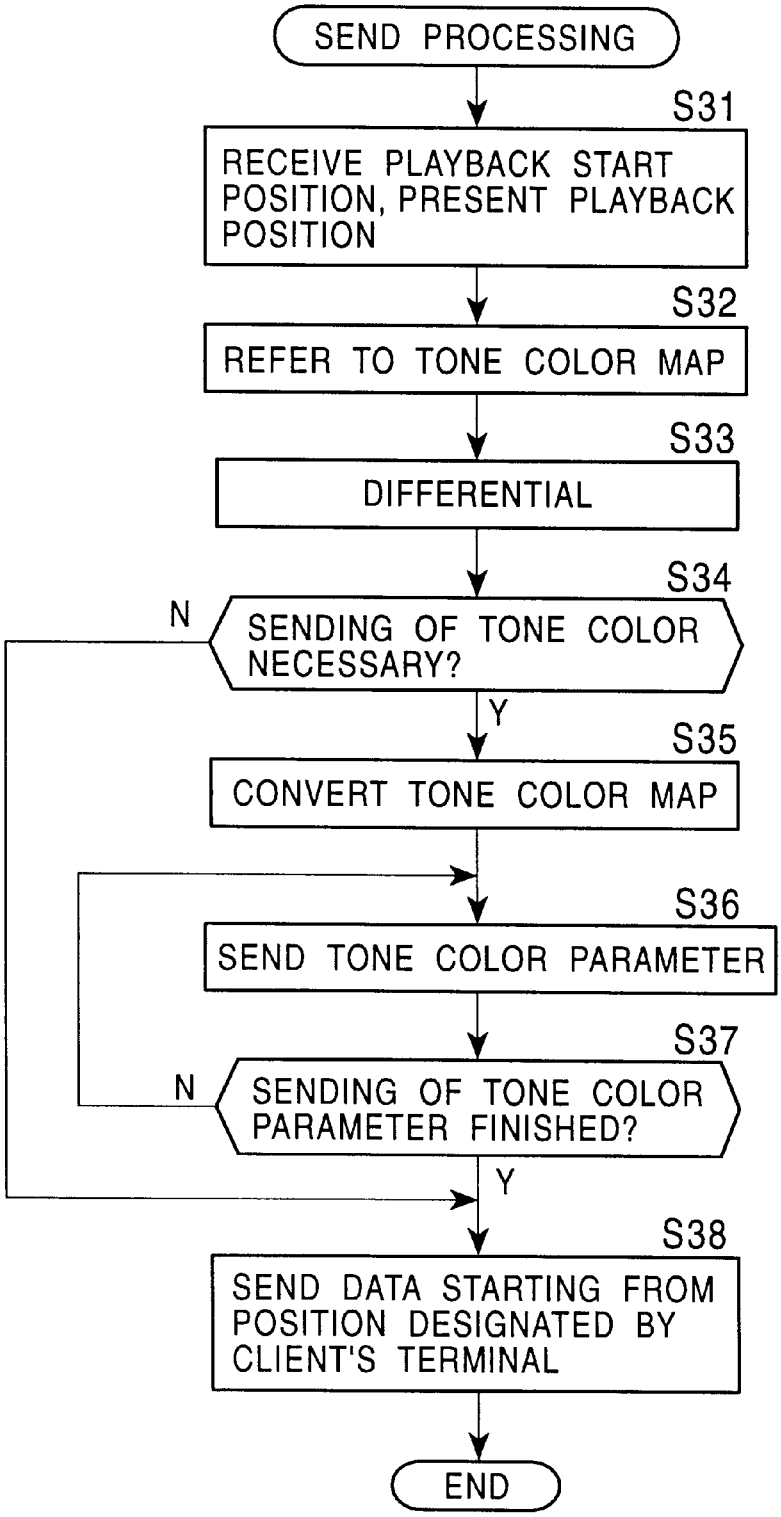
FIG. 13 is a flow diagram showing the second sending method for sending the tone color map.

Referring to a flow diagram shown in FIG. 13, the second method of send processing is discussed. The client terminal 3 here sends the present playback position together with the file name of the SMF requested for playback and the playback start position.

When the file name of the SMF requested for playback, the playback start position, and the present playback position come from the client terminal 3 via the network 2, the server 1 receives the file name, the playback start position and the present playback position at the demand processing section 35 in step S31, and feeds them to read processing section 34. Upon receiving the file name, the playback start position and the present playback position, the read processing section 34 reads, from the tone color map database 33, the tone color map corresponding to the file name and the playback start position, and the tone color map corresponding to the file name and the present playback position in step S32. Specifically, the read processing section 34 reads, from the tone color map database 33, a tone color map in which the time immediately prior to the playback start position is an effective time (hereinafter referred to as start map) and a tone color map in which the time immediately prior to the present playback position is an effective time (hereinafter referred to as present map), out of the tone color maps generated for the file name of the SMF requested through the demand processing section 35. The server 1 now recognizes that the tone color parameter placed in the present map now read is the one set in the musical instrument 4.

The read processing section 34 determines the differential information between the start map and the present map in step S33. The process goes to step S34 to determine whether the sending of the differential information to the client terminal 3 is necessary. When it is determined in step S34 that the sending of the differential information is not necessary, in other words, there is no differential information (i.e., the tone color parameters and their parameter values placed in the start map and the present map fully coincide with each other), the process goes to step S38, skipping steps S35 through S37. The read processing section 34 reads, from the MIDI file database 31, the SMF of the file name from the demand processing section 35 in the same manner as in step S26 shown in FIG. 10. The read processing section 34 feeds, to the sending circuit 36, the data that is recorded after the playback start position requested through the demand processing section 35, for transmission, and ends the send processing.

When it is determined in step S34 that the sending of the differential information is necessary, i.e., the tone color parameters placed in the start map and the present map do not fully coincide with each other, the process goes to step S35. The tone color map conversion process is performed on the differential information in the same manner as in step S23 as shown in FIG. 10. In this case, the effective time, the tempo information and the beat information placed in the start map are also used.

The process goes to step S36. Steps S36 through S38, respectively identical to steps S24 through S26 shown in FIG. 10, are then performed, ending the'send processing.

Figure 14:
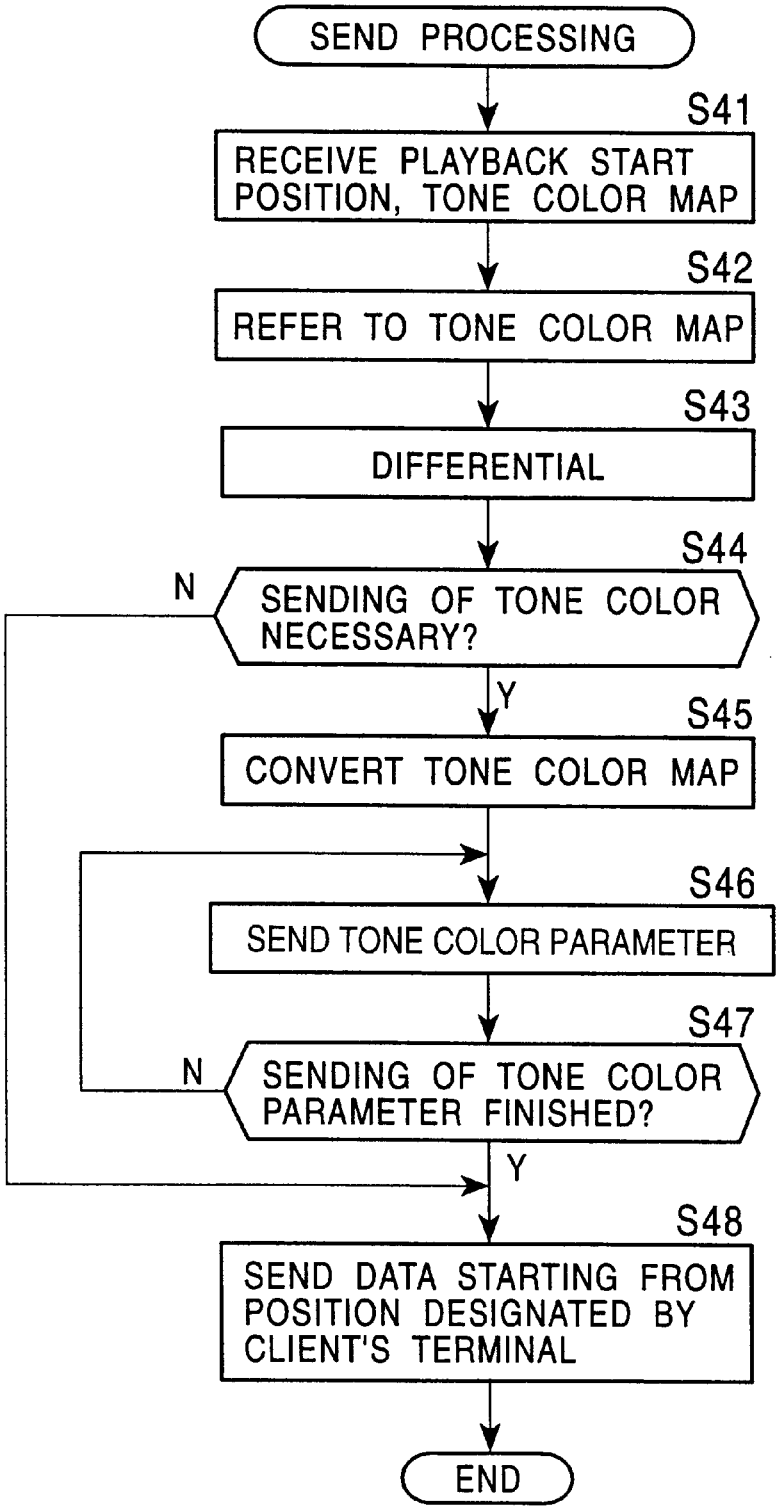
FIG. 14 is a flow diagram showing the third sending method for sending the tone color map.

Referring to a flow diagram shown in FIG. 14, the third method of send processing is discussed. The client terminal 3 here sends the tone color map placed in the tone color parameter set in the musical instrument 4 (hereinafter also referred to as present map) along with the file name of the SMF requested for playback and the playback start position.

When the SMF file name requested for playback, the playback start position, and the present playback position comes from the client terminal 3 via the network 2, the server 1 receives the file name, the playback start position and the present map at its the demand processing section 35 in step S41, and feeds them to its read processing section 34. Upon receiving the file name, the playback start position and the present map, the read processing section 34 reads, from the tone color map database 33, the tone color map corresponding to the file name and the playback start position in step S42. Specifically, the read processing section 34 reads, from the tone color map database 33, a tone color map in which the time immediately prior to the playback start position is an effective time (start map), out of the tone color maps generated for the SMF having the file name requested through the demand processing section 35.

The read processing section 34 determines the differential information between the start map and the present map sent from the client terminal 3 in step S43, and then goes to step S44. Steps S44 through S48, respectively identical to steps S34 through S38 shown in FIG. 13, are then performed, ending the send processing.

When the SMF file holds data for a plurality of MIDI channels, the server 1 may perform the tone color map generation process and the sending process, with the plurality of MIDI channels processed independently from one another or with at least two MIDI channels collectively processed.

In the send processing, the tone color map in which the time immediately prior to the playback start position is the effective time is sent only once in principle. When the client terminal 3 requests the playback of an SMF, the tone color map generated for the SMF may be periodically sent. The tone color parameter set in the musical instrument 4, as the MIDI device, is easily modified. When the user of the client terminal 3 modifies the tone color parameter set in the musical instrument 4, the musical instrument 4 may not play music at the tone color the composer of the SMF intends to present. By periodically sending the entire tone color map, the tone color parameter may be defaulted to its original tone color parameter even when the user of the client terminal 3 modifies the tone color parameter set in the musical instrument 4. The musical instrument 4 is prevented from playing music at the tone color the composer of the SMF does not intend to present. Since the entire tone color map generated for the SMF requested by the user is sent in this case, it is not necessary to send the tone color parameter out of the data recorded in the SMF in the MIDI file database 31.

Figure 15:
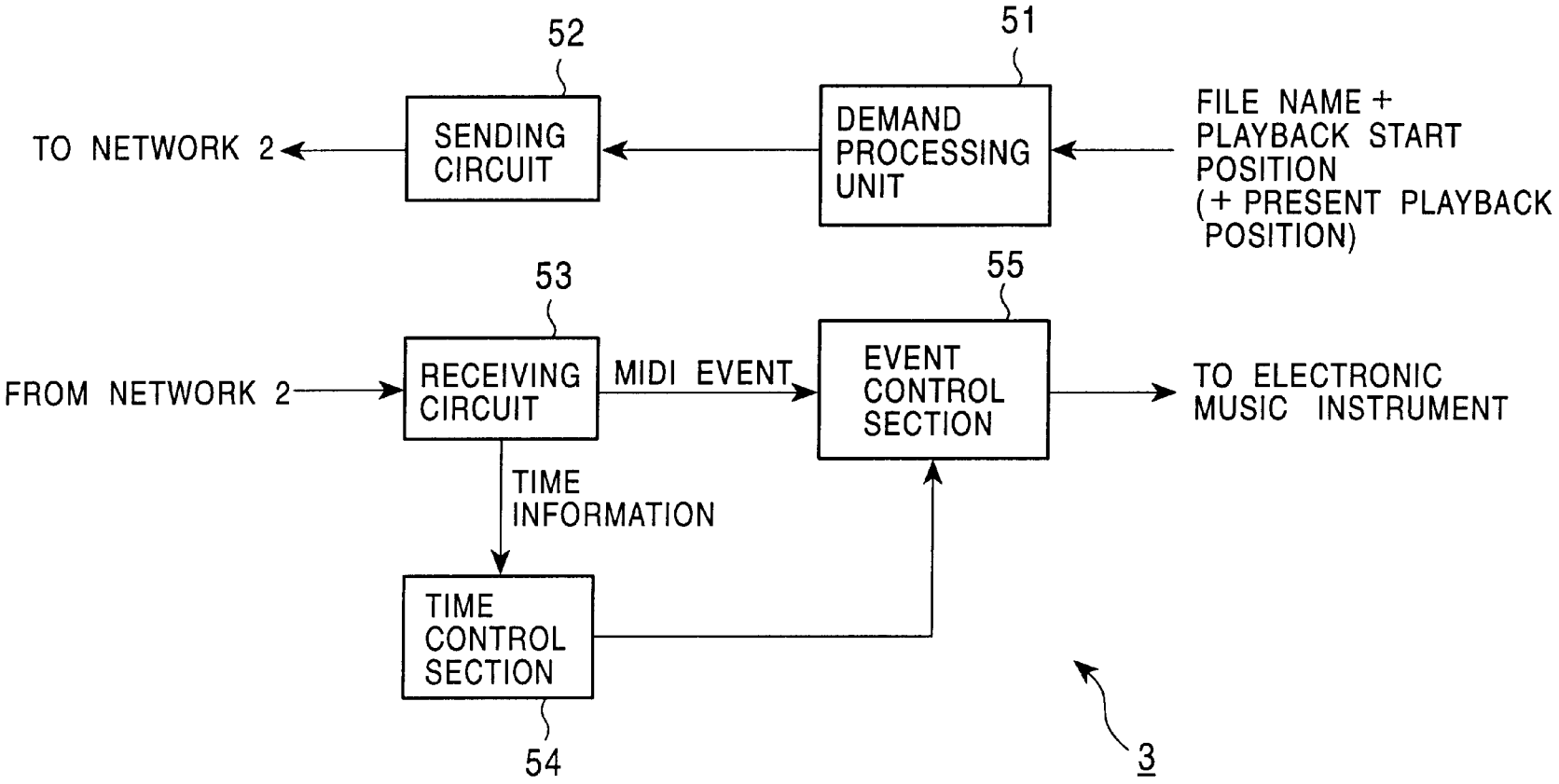
FIG. 15 is a functional block diagram of the client terminal 3 shown in FIG. 3.

FIG. 15 is a functional block diagram of the client terminal 3 shown in FIG. 3. The construction shown in FIG. 15 is realized with CPU 22 executing the application programs stored in the external storage device 26.

A demand processing unit 51 is supplied with the file name of the SMF requested for playback, the playback start position, and, as necessary, the present playback position, when the user of the client terminal 3 operates the input device 24. Based on these data, the demand processing unit 51 organizes SMF requesting data requesting an SMF from the server 1, and feeds it to a sending circuit 52. The sending circuit 52 sends the requesting data from the demand processing unit 51 to the server 1 vie the network 2.

A receiving circuit 53 receives the tone color parameter, MIDI events, and the time information associated with each MIDI event, coming in from the server 1 via the network 2. The MIDI event is fed to an event control section 55 and the time information is fed to a time control section 54. The time control section 54 counts unshown clocks for time counting, and outputs a control signal to the event control section 55 at the timing corresponding to the time information from the receiving circuit 53. The event control section 55 feeds the MIDI event from the receiving circuit 53 to the musical instrument 4 in response to the control signal supplied by the time control section 54.

Figure 16:
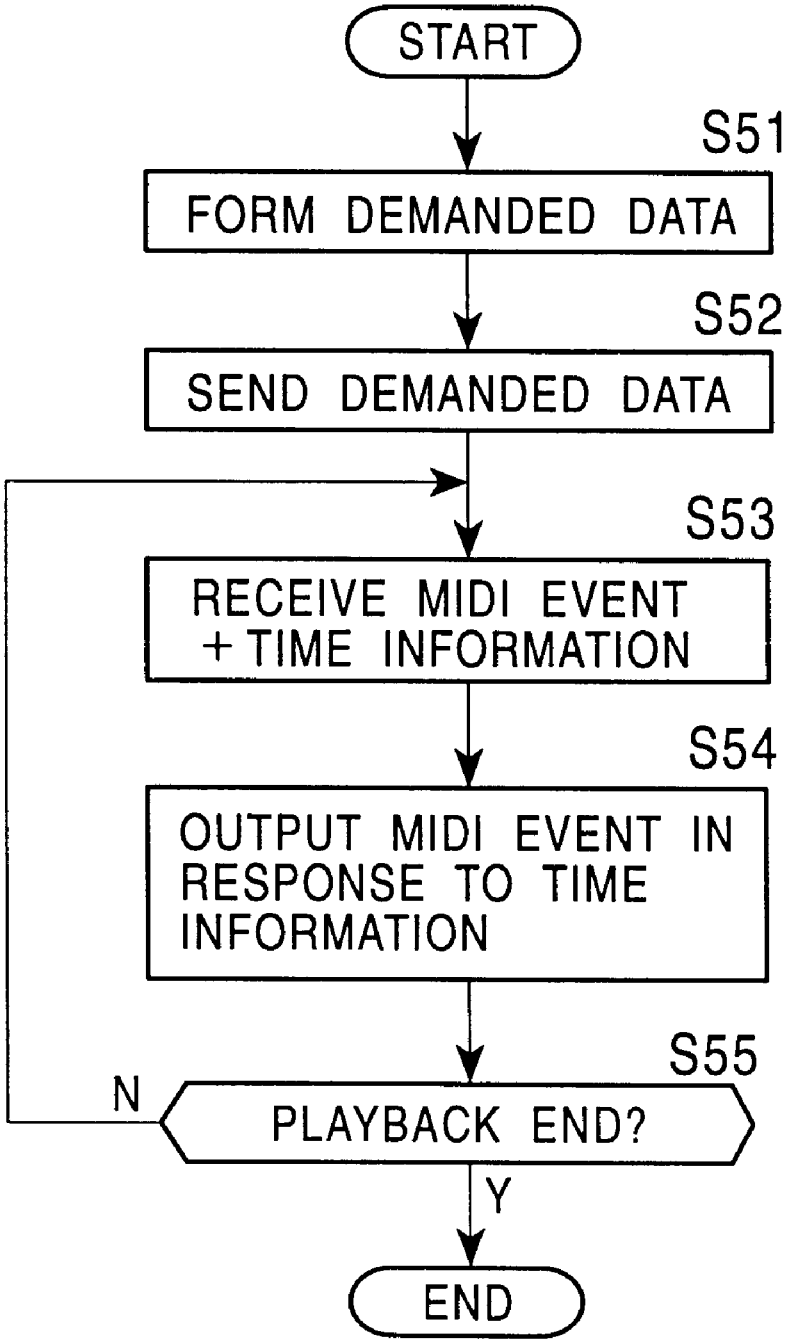
FIG. 16 is a flow diagram showing the process executed by the client terminal 3 shown in FIG. 15.

Referring to a flow diagram shown in FIG. 16, the operation of the client terminal 3 is discussed.

When the user of the client terminal 3 operates the input device 24 to input the file name of the SMF for playback and the playback start time (and further the present playback position), these pieces of information are fed to the demand processing unit 51. The demand processing unit 51 forms SMF requesting data requesting an SMF in accordance with the information input through the operation of the input device 24 in step S51, and feeds it to the sending circuit 52. The sending circuit 52 sends the requesting data from the demand processing unit 51 in step S52.

The time information corresponding to the MIDI event comes in from the server 1 via the network 2 as discussed above. The receiving circuit 53 in the client terminal 3 receives the MIDI event and the time information in step S53. The MIDI event is fed to the event control section 55 while the time information is fed to the time control section 54.

The time control section 54 outputs the control signal to the event control section 55 at the time corresponding to the time information from the receiving circuit 53. In response, the event control section 55 outputs the MIDI event from the receiving circuit 53 to the musical instrument 4 in step S54, and the musical instrument 4 sets the tone color corresponding to the MIDI event and outputs the corresponding sound. The process goes to step S55 to determine whether the input device 24 is operated to end the playback. When it is determined that the input device 24 is not so operated, the process returns to step S53 after the next MIDI event and time information come in. When it is determined in step S55 that the input device 24 is operated to end the playback, the process ends.

Figure 17:
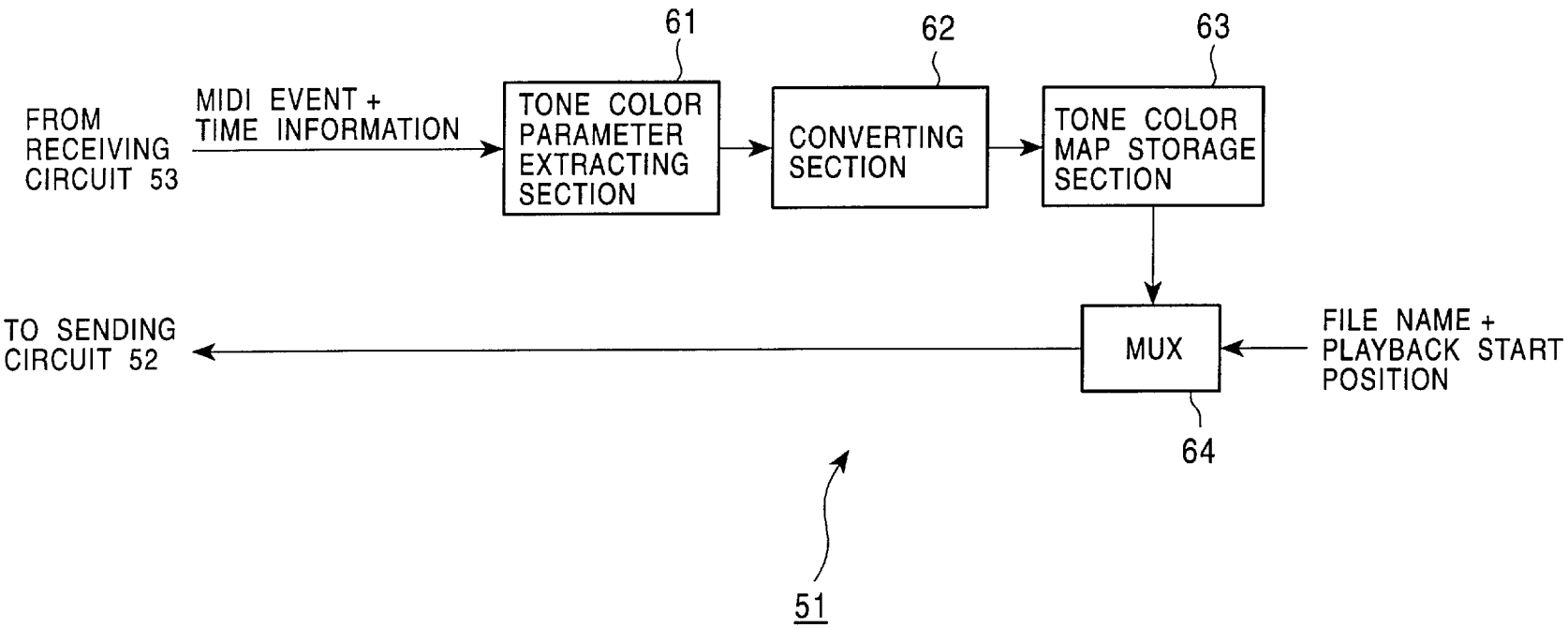
FIG. 17 is a functional block diagram of a demand processing section 51 shown in FIG. 15.

FIG. 17 is a functional block diagram of a demand processing section 51, in which the present map is sent when the client terminal 3 requests the playback of the SMF from the server 1.

The demand processing unit 51 is supplied with the MIDI event and the time information, received from the receiving circuit 53, and these pieces of information are fed to a tone color parameter extracting section 61.

Upon receiving the MIDI event and the time information, the tone color parameter extracting section 61 determines whether the MIDI event is a tone color parameter. When the tone color parameter extracting section 61 determines that the MIDI event is a tone color parameter, it feeds the MIDI event and the time information to a converting section 62. Based on the MIDI event (tone color parameter, in this case) and the time information from the tone color parameter extracting section 61, the converting section 62 generates a tone me color map, for example, in the same way that the server 1 generates the tone color map in the tone color map generation process. The tone color map is sent to a tone color map storage section 63, and replaces the tone color map already stored there. The tone color map storage section 63 thus always stores an updated tone color map (a set of tone color parameters).

When the user operates the input device 24 to input the file name of the SMF requesting the playback and the playback start position, these pieces of information are fed to a multiplexor (MUX) 64. Upon receiving the file name and the playback start position, the multiplexor 64 recognizes the tone color map stored in the tone color map storage section 63 as a present map, adds it to the file name and the playback start position, and outputs them to the sending circuit 52 as requesting data.

Figure 18:
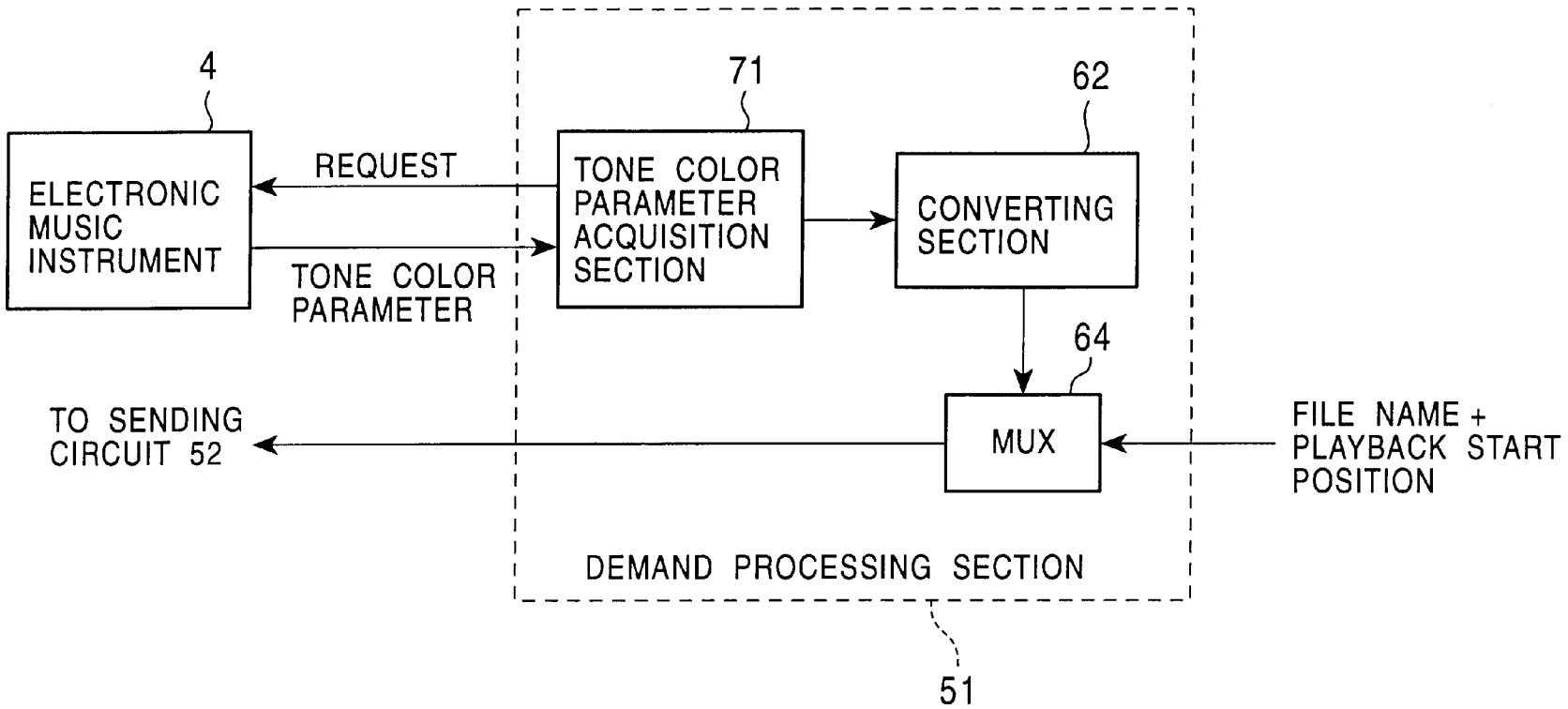
FIG. 18 is a functional block diagram of another example of the demand processing section 51.

FIG. 18 is another functional block diagram of the demand processing unit 51, in which the present map is sent when the client terminal 3 requests the playback of the SMF from the server 1. In FIG. 18, components identical to those described with reference to FIG. 17 are designated with the same reference numerals.

When the input device 24 is operated to input the file name of the SMF requested for playback and the playback start position in the embodiment shown in FIG. 18, these pieces of information are also input to the multiplexor 64. A tone color parameter acquisition section 71 outputs, to the musical instrument 4, a requesting signal requesting the tone color parameter presently set in the musical instrument 4. When the musical instrument 4 feeds the set tone color parameter to the tone color parameter acquisition section 71 in response to the requesting signal, the tone color parameter acquisition section 71 converts the tone color parameter into a tone color map through the converting section 62, and then feeds it to the multiplexor 64. The multiplexor 64 recognizes the tone color map supplied through the converting section 62 as a present map, adds it to the input file name and playback start position, and outputs them to the sending circuit 52 as requesting data.

In the embodiments, the server 1 sends the MIDI signal to the client terminal 3 through the network 2. The server 1 and the client terminal 3 may be organized in a single apparatus, and the single apparatus may control the musical instrument 4. Alternatively, the server 1, the client terminal 3 and the musical instrument 4 may all be organized in a single apparatus.

It is possible to record an SMF and the tone color map for the SMF in a single storage medium. Alternatively, the SMF only may be stored in a storage medium. When the storage medium is loaded in a reproducing apparatus for reproducing the SMF, the tone color map for the SMF is created and temporarily stored in the reproducing apparatus. When the storage medium is writable, the created tone color map is stored there.

Although the above embodiments have been discussed in connection with the MIDI, the present invention is not limited to the MIDI. The present invention may be implemented in a voice synthesizer or other apparatus for generating an audio signal based on data (mixed data) in which a tone color parameter and an interval parameter are mixed. If the present invention is implemented in a voice synthesizer, a control parameter for determining the tone color of a synthesized voice corresponds to the tone color parameter, and a control parameter determining a pitch and time of voice.

In the above embodiments, the effective time of the tone color map (see FIG. 7) is expressed in measures and beats. Alternatively, the effective time may be expressed in hours, minutes, and seconds. When the effective time is expressed in hours, minutes and seconds, computing time in accordance with the tempo and beat of a song is required. For this reason, the effective time is preferably expressed in measures and beats.

In the tone color map conversion process (step S23 in FIG. 10) through the read processing section 34, the time information of the tone color parameter is so set that the tone color parameters are equally spaced. This is not a requirement. The time information that provides unequally spaced tone color parameters is acceptable.

The network 2 may be wire or wireless. It is important that the network 2 be bidirectional.

The processed to be executed by the server 1 shown in FIG. 4 and the client terminal 3 shown in FIG. 15 may be performed by running a CPU (computer) under the control of a program. Alternatively, the processes are performed by respective dedicated hardware.

When the processes to be executed by the server 1 and the client terminal 3 are performed under the control of a computer program, the computer program may be supplied in a CD-ROM or supplied through a transmission medium such as the Internet.

In the above embodiments, the data output by the server 1 is supplied to the client terminal 3 via the network 2 as a transmission medium. Alternatively, the data output by the server 1 may be stored in a storage medium such as a CD-ROM to supply it to the client terminal 3.

In the information processing apparatus, the information processing method, and the storage medium, the tone color parameter and the effective time for making the tone color parameter effective are extracted from the mixed data, and the tone color parameter is then stored in a tabular form. The tone color parameter stored is read in response to the input of the playback start position for starting the playback of the mixed data. The time information indicating time to set the read tone color parameter is generated in the electronic apparatus for generating the audio signal based on the mixed data. The read tone color parameter is output together with the corresponding time information, and the mixed data is output from the playback start position. Even if an access is randomly made to the mixed data in which the tone color parameter and the interval parameter are mixed, the sound having the original tone color is thus reproduced.

The tone color parameter set in the electronic apparatus is recognized, and is then sent to the transmitter device. The transmitter device thus recognizes the tone color parameter set in the electronic apparatus.

What is claimed is:

1. An information processing apparatus for processing mixed data, in which, at least, a tone color parameter relating to a tone color and an interval parameter relating to an interval are mixed, the information processing apparatus comprising:

extracting means for extracting, from the mixed data, a chronologically earlier tone color parameter, a chronologically later tone color parameter and respective times corresponding to each tone color parameter;

comparing means for comparing a time differential between a chronologically earlier tone color parameter and a chronologically later tone color parameter with a predetermined threshold time;

storage means for storing the chronologically later tone color parameter onto a first memory which also stores the chronologically earlier tone color parameter or onto a second memory, based on a comparison result of the comparing means;

reading means for reading the tone color parameter from the storage means in accordance with an input of a playback start position where the playback of the mixed data starts;

creating means for creating time information indicating time to set the tone color parameter, read by the reading means, to an electronic apparatus that generates an audio signal based on the mixed data; and output means for outputting the tone color parameter, read by the reading means, together with the time information corresponding to the tone color parameter, and then the mixed data from the playback start position thereafter.

2. An information processing apparatus according to claim 1, further comprising copying means for copying the content of a table that stores the chronologically earlier tone color parameter, onto a new table, when the chronologically later tone color parameter is stored onto the new table.

3. An information processing apparatus according to claim 1, wherein the reading means reads a tone color parameter from a table that stores tone color parameters, an earliest effective time of which is immediately prior to the playback start position.

4. An information processing apparatus according to claim 3, further comprising differential information computing means for computing differential information between the tone color parameter read by the reading means and the tone color parameter set in the electronic apparatus, wherein the electronic apparatus controls the generated audio signal based on the tone color parameter set therein, and wherein the output means outputs the differential information as the tone color parameter read by the reading means.

5. An information processing apparatus according to claim 4, further comprising receiving means for receiving the tone color parameter that is set in the electronic apparatus and sent by a control device for controlling the electronic apparatus.

6. An information processing apparatus according to claim 4, further comprising receiving means for receiving the position of the mixed data that is played back by the electronic apparatus and sent by a control device for controlling the electronic apparatus, and recognizing means for recognizing the tone color parameter set in the electronic apparatus, based on the position of the mixed data received by the receiving means.

7. An information processing apparatus according to claim 1, further comprising supplying means for supplying the electronic apparatus with the tone color parameter output by the output means, based on the time information output by the output means.

8. An information processing apparatus according to claim 7, further comprising the electronic apparatus.

9. An information processing apparatus according to claim 1, wherein the mixed data meets the MIDI (Musical Instruments Digital Interface) standard, and wherein the electronic apparatus is a MIDI device.

10. An information processing apparatus according to claim 9, the tone color parameter includes at least one of a program change, a control change, an exclusive message, a piece of tempo information and a piece of time pattern information, specified in the MIDI standard.

11. An information processing apparatus according to claim 9, wherein when the mixed data is for a plurality of MIDI channels, the extracting means, the storage means, the reading means, the creating means, and the output means perform the respective processes with the plurality of MIDI channels processed independently of one another.

12. An information processing apparatus according to claim 9, wherein when the mixed data is for a plurality of MIDI channels, the extracting means, the storage means, the reading means, the creating means, and the output means perform the respective processes with at least two MIDI channels collectively processed.

13. An information processing apparatus according to claim 1, wherein the electronic apparatus is a voice synthesizer.

14. An information processing method for processing mixed data, in which, at least, a tone color parameter relating to a tone color and an interval parameter relating to an interval are mixed, the information processing method comprising the steps of:

extracting, from the mixed data, a chronologically earlier tone color parameter, a chronologically later tone color parameter and respective times corresponding to each tone color parameter;

comparing a time differential between the chronologically earlier tone color parameter and the chronologically later tone color parameter with a predetermined threshold time;

storing the chronologically later tone color parameter onto a first memory which also stores the chronologically earlier tone color parameter or onto a second memory, based on a comparison result of the comparing means;

reading the tone color parameter, stored in the storing step, in accordance with an input of a playback start position where the playback of the mixed data starts;

creating time information indicating time to set the tone color parameter, read in the reading step, to an electronic apparatus that generates an audio signal based on the mixed data; and outputting the tone color parameter, read in the reading step, together with the time information corresponding to the tone color parameter, and then the mixed data from the playback start position thereafter.

15. An information processing method according to claim 14, further comprising a copying step for copying the content of a table that stores the chronologically earlier tone color parameter, onto a new table, when the chronologically later tone color parameter is stored onto the new table.

16. An information processing method according to claim 14, wherein the reading step reads a tone color parameter from a table that stores tone color parameters, an earliest effective time of which is immediately prior to the playback start position.

17. An information processing method according to claim 16, further comprising a differential information computing step for computing differential information between the tone color parameter read in the reading step and the tone color parameter set in the electronic apparatus, wherein the electronic apparatus controls the generated audio signal based on the tone color parameter set therein, and wherein the output step outputs the differential information as the tone color parameter read in the reading step.

18. An information processing method according to claim 17, further comprising a receiving step for receiving the tone color parameter that is set in the electronic apparatus and sent by a control device for controlling the electronic apparatus.

19. An information processing method according to claim 17, further comprising a receiving step for receiving the position of the mixed data that is played back by the electronic apparatus and sent by a control device for controlling the electronic apparatus, and a recognizing step for recognizing the tone color parameter set in the electronic apparatus, based on the position of the mixed data received in the receiving step.

20. An information processing method according to claim 14, further comprising a supplying step for supplying the electronic apparatus with the tone color parameter output in the output step, based on the time information output in the output step.

21. An information processing method according to claim 14, wherein the mixed data meets the MIDI (Musical Instruments Digital Interface) standard, and wherein the electronic apparatus is a MIDI device.

22. An information processing method according to claim 21, wherein the tone color parameter includes at least one of a program change, a control change, an exclusive message, a piece of tempo information and a piece of time pattern information, specified in the MIDI standard.

23. An information processing method according to claim 21, wherein when the mixed data is for a plurality of MIDI channels, the extracting step, the storing step, the reading step, the creating step, and the output step perform the respective processes with the plurality of MIDI channels processed independently one another.

24. An information processing method according to claim 21, wherein when the mixed data is for a plurality of MIDI channels, the extracting step, the storing step, the reading step, the creating step, and the output step perform the respective processes with at least two MIDI channels collectively processed.

25. An information processing method according to claim 14, wherein the electronic apparatus is a voice synthesizer.

26. A medium for providing a computer program, according to which a computer processes mixed data, in which, at least, a tone color parameter relating to a tone color and an interval parameter relating to an interval are mixed, the computer program comprising the steps of:

extracting, from the mixed data, a chronologically earlier tone color parameter, a chronologically later tone color parameter and respective times corresponding to each tone color parameter;

comparing a time differential between the chronologically earlier tone color parameter and the chronologically later tone color parameter with a predetermined threshold time;

storing the chronologically later tone color parameter onto a first memory which also stores the chronologically earlier tone color parameter or onto a second memory, based on a comparison result of the comparing means;

reading the tone color parameter, stored in the storing step, in accordance with an input of a playback start position where the playback of the mixed data starts;

creating time information indicating time to set the tone color parameter, read in the reading step, to an electronic apparatus that generates an audio signal based on the mixed data; and outputting the tone color parameter, read in the reading step, together with the time information corresponding to the tone color parameter, and then the mixed data from the playback start position thereafter.

27. A medium according to claim 26, wherein the computer program further comprises a copying step for copying the content of the table that stores the chronologically earlier tone color parameter, onto the new table, when the chronologically later tone color parameter is stored onto the new table.

28. A medium according to claim 26, wherein the reading step reads a tone color parameter from a table that stores tone color parameters, the earliest effective time of which is immediately prior to the playback start position.

29. A medium according to claim 28, wherein the computer program further comprises a differential information computing step for computing differential information between the tone color parameter read in the reading step and the tone color parameter set in the electronic apparatus, wherein the electronic apparatus controls the generated audio signal based on the tone color parameter set therein, and wherein the output step outputs the differential information as the tone color parameter read in the reading step.

30. A medium according to claim 29, wherein the computer program further comprises a receiving step for receiving the tone color parameter that is set in the electronic apparatus and sent by a control device for controlling the electronic apparatus.

31. A medium according to claim 29, wherein the computer program further comprises a receiving step for receiving the position of the mixed data that is played back by the electronic apparatus and sent by a control device for controlling the electronic apparatus, and a recognizing step for recognizing the tone color parameter set in the electronic apparatus, based on the position of the mixed data received in the receiving step.

32. A medium according to claim 26, wherein the computer program further comprises a supplying step for supplying the electronic apparatus with the tone color parameter output in the output step, based on the time information output in the output step.

33. A medium according to claim 26, wherein the mixed data meets the MIDI (Musical Instruments Digital Interface) standard, and wherein the electronic apparatus is a MIDI device.

34. A medium according to claim 33, herein the tone color parameter includes at least one of a program change, a control change, an exclusive message, a piece of tempo information and a piece of time pattern information, specified in the MIDI standard.

35. A medium according to claim 33, wherein when the mixed data is for a plurality of MIDI channels, the extracting step, the storing step, the reading step, the creating step, and the output step perform the respective processes with the plurality of MIDI channels processed independently one another.

36. A medium according to claim 33, wherein when the mixed data is for a plurality of MIDI channels, the extracting step, the storing step, the reading step, the creating step, and the output step perform the respective processes with at least two MIDI channels collectively processed.

37. A medium according to claim 26, wherein the electronic apparatus is a voice synthesizer.

38. An information processing apparatus for receiving mixed data that is transmitted by a transmitter device, with the mixed data at least including a tone color parameter relating to a tone color and an interval parameter relating to an interval, and for supplying the mixed data to an electronic apparatus that generates an audio signal based on the mixed data, the information processing apparatus comprising:

recognizing means for recognizing the tone color parameter set in the electronic apparatus;

sending means for sending, to the transmitter device, the tone color parameter recognized by the recognizing means;

extracting means for extracting the tone color parameter from the mixed data sent by the transmitter device; and storage means for storing a latest set of tone color parameter extracted by the extracting means, wherein the recognizing means recognizes the content of the storage means as the tone color parameter set in the electronic apparatus.

39. An information processing apparatus for receiving mixed data that is transmitted by a transmitter device, with the mixed data at least including a tone color parameter relating to a tone color and an interval parameter relating to an interval, and for supplying the mixed data to an electronic apparatus that generates an audio signal based on the mixed data, the information Processing apparatus, the information processing apparatus comprising:

recognizing means for recognizing the tone color parameter set in the electronic apparatus;

sending means for sending, to the transmitter device, the tone color parameter recognized by the recognizing means; and demanding means for demanding the tone color parameter set in the electronic apparatus from the electronic apparatus, wherein the recognizing means recognizes, as the tone color parameter set in the electronic apparatus, the tone color parameter, which the electronic apparatus outputs in response to the demand of the demanding means.

40. An information processing method for receiving mixed data that is transmitted by a transmitter device, with the mixed data at least including a tone color parameter relating to a tone color and an interval parameter relating to an interval, and for supplying the mixed data to an electronic apparatus that generates an audio signal based on the mixed data, the information processing method comprising the steps of:

recognizing the tone color parameter set in the electronic apparatus;

sending, to the transmitter device, the tone color parameter recognized in the recognizing step;

extracting the tone color parameter from the mixed data sent by the transmitter device; and storing a latest set of tone color parameter extracted by the extracting means, wherein the recognizing step recognizes the content stored in the storing step as the tone color parameter set in the electronic apparatus.

41. An information processing method for receiving mixed data that is transmitted by a transmitter device, with the mixed data at least including a tone color parameter relating to a tone color and an interval parameter relating to an interval, and for supplying the mixed data to an electronic apparatus that generates an audio signal based on the mixed data, the information processing method comprising the steps of:

recognizing the tone color parameter set in the electronic apparatus;

sending, to the transmitter device, the tone color parameter recognized in the recognizing step;

demanding the tone color parameter set in the electronic apparatus from the electronic apparatus, wherein the recognizing step recognizes the tone color parameter, which the electronic apparatus outputs in response to the demand of the demanding step, as the tone color parameter set in the electronic apparatus.

42. A medium for providing a computer program, according to which a computer performs processes for receiving mixed data that is transmitted by a transmitter device, with the mixed data at least including a tone color parameter relating to a tone color and an interval parameter relating to an interval, and for supplying the mixed data to an electronic apparatus that generates an audio signal based on the mixed data, the computer program comprising the steps of:

recognizing the tone color parameter set in the electronic apparatus;

sending, to the transmitter device, the tone color parameter recognized in the recognizing step;

extracting the tone color parameter from the mixed data sent by the transmitter device; and storing a latest set of tone color parameter extracted by the extracting means, wherein the recognizing step recognizes the content stored in the storing step as the tone color parameter set in the electronic apparatus.

43. A medium for providing a computer program, according to which a computer performs processes for receiving mixed data that is transmitted by a transmitter device, with the mixed data at least including a tone color parameter relating to a tone color and an interval parameter relating to an interval, and for supplying the mixed data to an electronic apparatus that generates an audio signal based on the mixed data, the computer program comprising the steps of:

recognizing the tone color parameter set in the electronic apparatus;

sending, to the transmitter device, the tone color parameter recognized in the recognizing step; and demanding the tone color parameter set in the electronic apparatus from the electronic apparatus, wherein the recognizing step recognizes, as the tone color parameter set in the electronic apparatus, the tone color parameter, which the electronic apparatus outputs in response to the demand of the demanding step.

* * * * *